US010347976B2

(12) United States Patent
Ziegler et al.

(10) Patent No.: US 10,347,976 B2
(45) Date of Patent: Jul. 9, 2019

(54) STACKED PRINTED CIRCUIT BOARD IMPLEMENTATIONS OF THREE DIMENSIONAL ANTENNAS

(71) Applicant: University of Idaho, Moscow, ID (US)

(72) Inventors: Jeremy Ziegler, Hood River, OR (US); Ata Zadehgol, Moscow, ID (US)

(73) Assignee: University of Idaho, Moscow, ID (US)

( * ) Notice: Subject to any disclaimer, the term of this patent is extended or adjusted under 35 U.S.C. 154(b) by 0 days.

(21) Appl. No.: 15/833,969

(22) Filed: Dec. 6, 2017

(65) Prior Publication Data

US 2018/0166776 A1 Jun. 14, 2018

Related U.S. Application Data

(60) Provisional application No. 62/432,389, filed on Dec. 9, 2016.

(51) Int. Cl.

| | |
|---|---|
| ***H01Q 1/36*** | (2006.01) |
| ***H01Q 1/48*** | (2006.01) |
| ***H01Q 1/50*** | (2006.01) |
| ***H01Q 1/52*** | (2006.01) |
| ***H01P 3/08*** | (2006.01) |

(52) U.S. Cl.

CPC ..... *H01Q 1/36* (2013.01); *H01P 3/08* (2013.01); *H01P 3/081* (2013.01); *H01Q 1/48* (2013.01); *H01Q 1/50* (2013.01); *H01Q 1/52* (2013.01); *H01Q 1/526* (2013.01)

(58) Field of Classification Search

CPC .. H01Q 1/36; H01Q 1/48; H01Q 1/50; H01Q 1/52; H01Q 1/526; H01P 3/08; H01P 3/081

USPC ..... 343/862

See application file for complete search history.

(56) References Cited

U.S. PATENT DOCUMENTS

| | | | | |
|---|---|---|---|---|
| 5,453,751 | A * | 9/1995 | Tsukamoto | H01Q 15/242 343/700 MS |
| 9,756,733 | B2 * | 9/2017 | Drzaic | G09G 3/20 |
| 2007/0018899 | A1 * | 1/2007 | Kunysz | H01Q 1/36 343/770 |
| 2011/0148707 | A1 * | 6/2011 | Thiesen | H01Q 3/2605 342/372 |
| 2012/0313822 | A1 * | 12/2012 | Long | H01Q 9/0407 343/700 MS |

(Continued)

OTHER PUBLICATIONS

Adams et al., "Design of spherical meanderline antennas," *Antennas and Propagation (APSURSI), 2011 IEEE International Symposium on*, pp. 765-768 (Jul. 2011).

(Continued)

*Primary Examiner* — Lam T Mai

(74) *Attorney, Agent, or Firm* — Klarquist Sparkman, LLP

(57) ABSTRACT

Three-dimensional antennas incorporate a stack of planar wiring boards, with conductive metallization on each board and electrical connectivity between conductive regions on adjacent boards. In one example of the disclosed technology, a three-dimensional antenna is formed from a stack of planar wiring boards, where each includes one or more disjoint metallizations in electrical contact with at least one disjoint metallization on an adjacent one of the planar wiring boards. Associated methods and variants are also disclosed.

20 Claims, 14 Drawing Sheets

(56) References Cited

U.S. PATENT DOCUMENTS

| | | | | |
|---|---|---|---|---|
| 2015/0197062 | A1* | 7/2015 | Shinar | B29C 64/386 700/98 |
| 2015/0197063 | A1* | 7/2015 | Shinar | G06F 17/50 700/98 |
| 2015/0201499 | A1* | 7/2015 | Shinar | H05K 3/125 425/132 |
| 2015/0201500 | A1* | 7/2015 | Shinar | H05K 3/125 425/132 |
| 2015/0349431 | A1* | 12/2015 | Odes | G06F 17/10 343/756 |
| 2017/0117620 | A1* | 4/2017 | Lapushin | H01Q 1/38 |
| 2018/0175901 | A1* | 6/2018 | Heo | H04B 1/40 |
| 2018/0288876 | A1* | 10/2018 | Mundt | H05K 1/181 |

OTHER PUBLICATIONS

Antenova m2m, "Rubra Penta-band SMD Antenna, Part No. A10393," available at: http://www.antenova-m2m.com/wp-content/uploads/2015/11/Rubra-A10393-PS-1-1.pdf, pp. 1-19 (document not dated, accessed before Nov. 2, 2017).

Best, "The performance properties of electrically small resonant multiple-arm folded wire antennas," *IEEE Antennas and Propagation Magazine*, vol. 47, No. 4, pp. 13-27 (Aug. 2005).

Best, "The radiation properties of electrically small folded spherical helix antennas, " *IEEE Transactions on Antennas and Propagation*, vol. 52, No. 4, pp. 953-960 (Apr. 2004).

Brister et al., "Design of a balanced ball antenna using a spherical helix wound over a full sphere," *Antennas and Propagation Conference* (*LAPC*), *2011 Loughborough*, pp. 1-4 (Nov. 2011).

Hansen, "Fundamental Limitations in Antennas," *Proceedings of the IEEE*, vol. 69, No. 2, pp. 170-182 (Feb. 1981).

Jastram et al., "PCB-Based Prototyping of 3-D Micromachined RF Subsystems," *IEEE Transactions on Antennas and Propagation*, vol. 62, No. 1, pp. 420-429 (Jan. 2014).

Kim, "Minimum Q Electrically Small Antennas," *IEEE Transactions on Antennas and Propagation*, vol. 60, No. 8, pp. 3551-3558 (Aug. 2012).

Kim, "3D printing electrically small spherical antennas," *Antennas and Propagation Society International Symposium* (*APSURSI*), *2013 IEEE*. pp. 776-777 (Jul. 7. 2013).

Linx Technologies, "Antenna Factor by Linx—Antenna Overview Guide," available at: https://linxtechnologies.com/wp/wp-content/uploads/catalog-antennas.pdf, 7 pages (document not dated, accessed before Nov. 21, 2017).

Linx Technologies, "Antenna Factor by Linx—Data Sheet," available at: https://www.linxtechnologies.com/wp/wp-content/uploads/ant-gps-sh-fff.pdf, 1 page (document not dated, accessed before Nov. 21, 2017).

Oshima et al., "3D integration techniques using stacked PCBs and small dipole antenna for wireless sensor nodes," *IEEE, CPMT Symposium Japan*, 4 pages (Dec. 2012).

Stuart et al., "Small spherical antennas using arrays of electromagnetically coupled planar elements," *IEEE Antennas and Wireless Propagation Letters*, vol. 6, pp. 7-10 (2007).

"Survey of Helical Antennas," available at: http://educypedia.karadimov.info/library/07chapter2, pp. 4-25 (document not dated, accessed before Nov. 16, 2016) (also published as Parry, "Remote Aerial Data Acquisition Concept—RADAC," University of Southern Queensland, Faculty of Engineering & Surveying, Dissertation, 466 pages (Oct. 29, 2009)).

TE Connectivity, "Consumer Devices—Standard Antenna Solutions," available at: http://www.te.com/commerce/DocumentDelivery/DDEController?Action=srchrtrv& DocNm=4-1773459-7&DocType=DS&DocLang=EN, pp. 1-57 (May 2014).

Ziegler et al., "Design and simulation of a four-arm hemispherical helix antenna realized through a stacked printed circuit board structure," in *Electrical Design of Advanced Packaging and Systems Symposium*(*EDAPS*), *2016 IEEE*, pp. 83-85 (Mar. 2016).

Ziegler et al., "Electrically small PCB stack hemispherical helix antenna with air core," *Antenna Technology: Small Antennas, Innovative Structures, and Applications* (*iWAT*), *2017 International Workshop on, IEEE*, 4 pages (Mar. 2017).

* cited by examiner (Comparative Example)

STACKED PRINTED CIRCUIT BOARD IMPLEMENTATIONS OF THREE DIMENSIONAL ANTENNAS

CROSS-REFERENCE TO RELATED APPLICATIONS

This application claims the benefit of U.S. Provisional Patent Application No. 62/432,389, filed Dec. 9, 2016, which is incorporated in its entirety herein by reference.

BACKGROUND

Electrically small antennas have a maximum dimension that is relatively small compared to the electrical wavelength, and have attracted attention in recent years largely for this reason. Applications include mobile phones, UHF, VHF, and lower frequency radio applications (where most practical antennas are compact), and microwave applications where miniaturization may be desirable.

In some applications, such as a multi-band radio, broadband performance is desirable, which is correlated to having a low quality factor (Q) value. The Chu limit defines a minimum achievable Q for a given size and wavelength of operation:

$$Q_{min} = \left(\frac{1}{(ka)^3} + \frac{1}{(ka)}\right) \tag{1}$$

where k is the wavenumber of the radiation ($2\pi$/wavelength) and $\alpha$ is the radius of an imaginary sphere that just encloses the antenna. Thus, it can be desirable to find antenna designs that approach the Chu limit. The hemispherical helix antenna is one such design, which has been demonstrated to achieve a Q of 1.5 times the Chu limit. FIG. 9, discussed further below, illustrates a four-arm hemispherical helix antenna in which each arm is integrally formed from a solid piece of wire.

However, the structure of a solid wire hemispherical helix presents a fabrication challenge in order to realize the designed geometry in a timely and inexpensive fashion. Accordingly, there remains ample opportunity for improved structures and design and manufacturing processes for three dimensional antennas.

SUMMARY

Three-dimensional antennas and methods for manufacturing the same are disclosed. In some examples, three-dimensional antennas are formed of a stack of planar wiring boards, thereby obtaining antennas that are mechanically robust and easy and inexpensive to manufacture. Three-dimensional antennas in a virtually unlimited range of physical configurations can be designed and manufactured using the disclosed technologies. In some examples, methods of rapid development and implementation of three-dimensional antennas at low cost, with a straightforward path to high-volume manufacturing are provided. The disclosed technologies are particularly advantageous for three-dimensional antenna structures having non-uniform cross-sections, or that cannot be simply approximated by a small number of planar or linear components.

According to certain examples of the disclosed technology, a three-dimensional antenna is fabricated as a stack of planar wiring boards. Each planar wiring board has one or more disjoint metallized and conducting regions that are electrically connected to the metallized and conducting regions of one or more neighboring planar wiring boards. Different exemplary antenna designs, board structures, metallizations, and joining features are described, which can be combined in many different ways to form a wide range of antennas. Some exemplary three-dimensional antennas can include additional features, for example: a feed, a ground plane, lumped element electrical components, electrical and/or mechanical fasteners or connectors, standoffs, alignment features, cavities, shielding, or coating layers.

According to certain examples of the disclosed technology, a manufacturing process includes fabricating a set of planar wiring boards with one or more disjoint metallized and conducting regions formed on each board. The boards are stacked and joined together, including forming electrical connections between metallized regions on neighboring boards. Different exemplary board manufacturing technologies, metallization technologies, and joining technologies are disclosed, which can be combined in diverse ways to form a wide-range of antennas according to the disclosed technologies. Some exemplary manufacturing processes can include additional features, for example: alignment, attachment to a ground plane, attachment of lumped electrical components, attachment of a feed, use of a jig to position one or more planar wiring boards, or application of a coating layer. In some examples, the boards are printed circuit boards or multi-chip module substrates fabricated from insulators such as epoxy, plastic, ceramic, or other suitable insulating substrates having conductor materials formed on one or more surfaces of the substrate.

According to certain examples of the disclosed technology, an example design process includes mapping an idealized design to a planar wiring board approximation. Interconnections are defined. The planar wiring boards are designed, whereby the parts required for any disclosed manufacturing process, or another manufacturing process, can become available. Variations of the design process are disclosed.

According to certain examples of the disclosed technology, an antenna includes at least one stacked three-dimensional antenna and can additionally include one or more stacked three-dimensional antennas of the same or different configuration, and/or one or more antenna modules. In certain examples, an antenna array incorporates an assembly of individual three-dimensional antennas, while in other examples, an antenna array includes two or more antennas sharing one, two, or more planar wiring boards.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, any trademarks used herein remain the property of their respective owners. The foregoing and other objects, features, and advantages of the invention will become more apparent from the following detailed description, which proceeds with reference to the accompanying figures.

DETAILED DESCRIPTION

I. Example Antenna Structure

Figure 1:
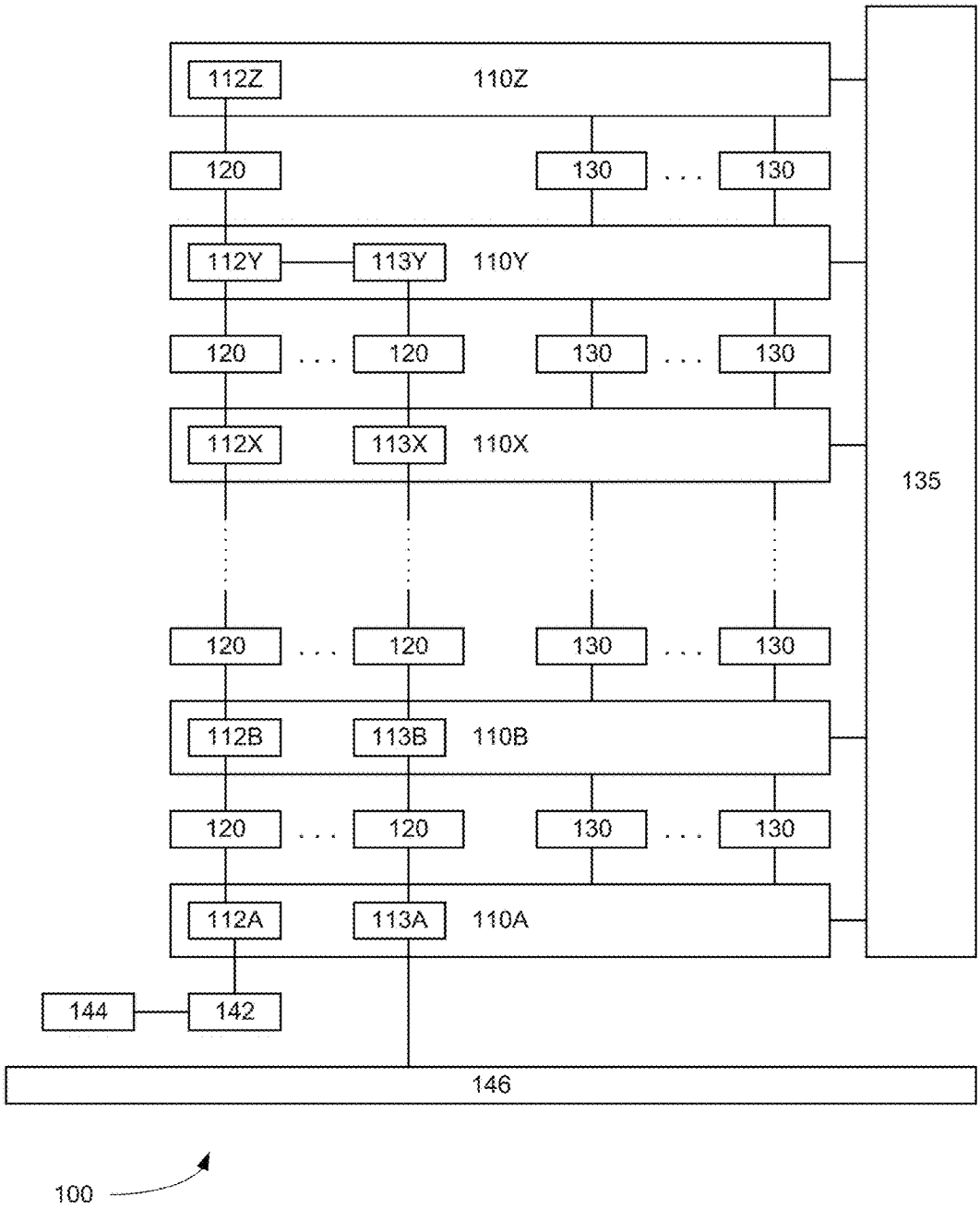
FIG. 1 is a schematic diagram of an example stacked antenna according to the disclosed technology.
Figure 2A:
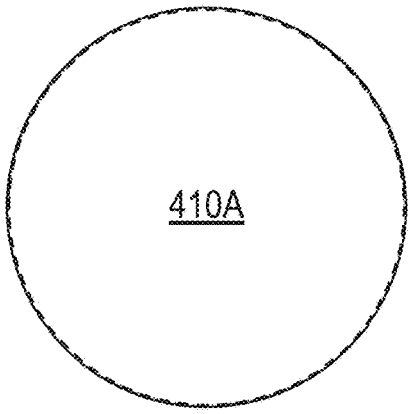
FIGS. 2A-2L are top views of an example set of planar wiring boards from which a disclosed antenna is formed.
Figure 2B:
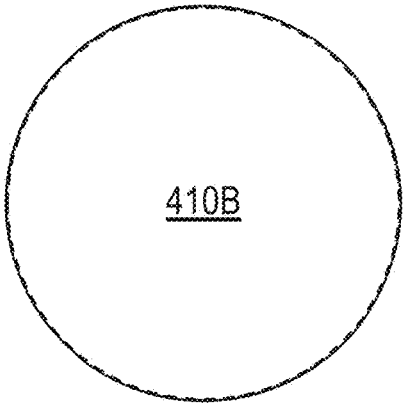
Figure 2C:
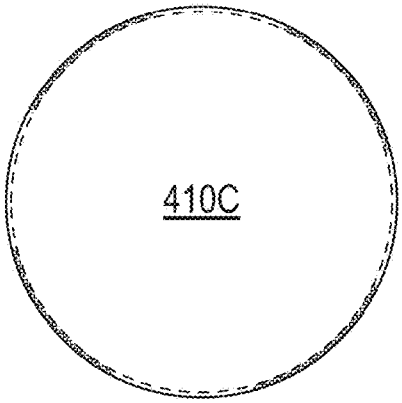
Figure 2D:
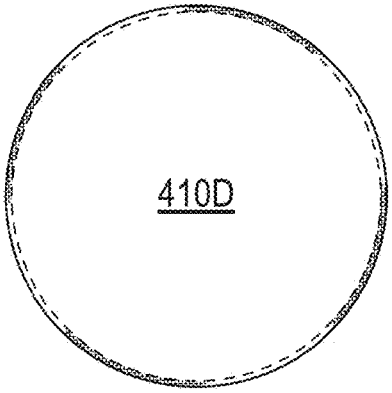
Figure 2E:
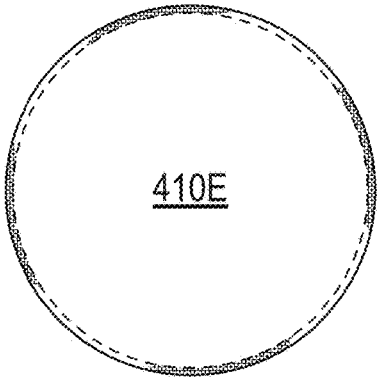
Figure 2F:
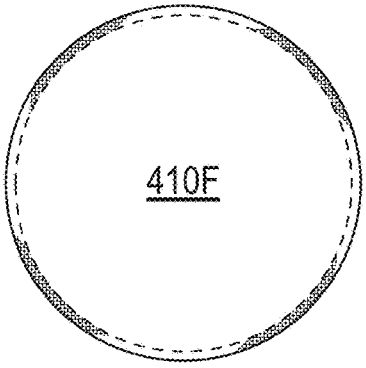
Figure 2G:
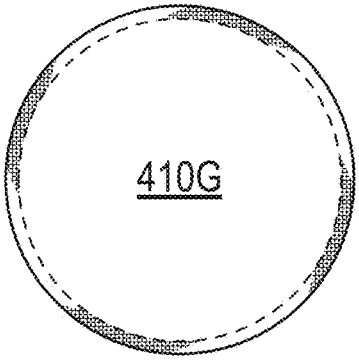
Figure 2J:
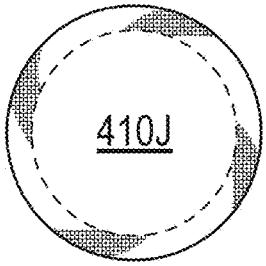
Figure 2H:
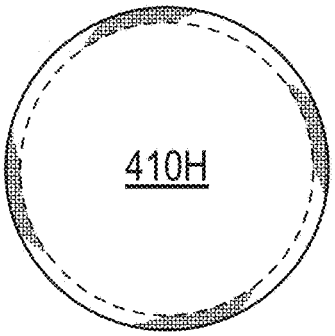
Figure 2K:
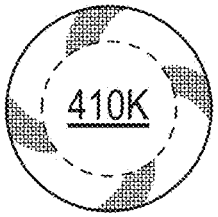
Figure 2I:
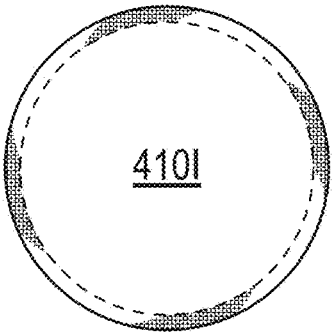
Figure 2L:
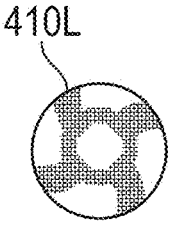

FIG. 1 is a schematic diagram depicting the structure of a stacked board antenna 100 according to an example of the disclosed technology. FIG. 4 is an illustration of a physical model of a corresponding exemplary stacked board antenna 400. Turning to FIG. 1, the antenna 100 has a plurality of substrates 110A-110Z. Board 110A has two separate conducting areas (dubbed disjoint metallizations) 112A and 113A, and the other boards 110B-110Z likewise have one or more metallizations 112B-112Z and 113B-113Z. The boards are assembled with electrical connections 120 joining pairs of electrical conductors on adjacent boards. Thus, as shown, a continuous conducting path is formed from 112A to 112Z, and also from 113A to 113Y. As shown in FIG. 1, conducting paths can traverse the entire stack of boards, but need not. Conducting paths can connect with each other on one or more boards, for example 112Y and 113Y connect to each other on board 110Y.

The antenna 400 of FIG. 4 has four helical antenna radiators, connected together on a top-most board, at the apex of a hemisphere. On a bottom-most board, one of the radiators can be connected to an antenna feed, while the other three radiators can be connected to a ground plane.

As will be readily apparent to one of ordinary skill in the art, the particular numbers of boards, conducting paths, and electrical connections in the example of FIG. 1 have been selected for the ease of illustration, but the scope of the disclosed technology is not limited by the illustration of FIG. 1. The number of boards can be any number greater than or equal to two. Thus, the number of boards can be 2, 3, 4, 5, 6, 7, 8, 9, 10, 11, 12, 13, 14, 15, 16, 17-20, 21-30, 31-50, 51-100, or even higher. An innovative antenna can even be made with a single flexible circuit board, folded to form a layer stack. Similarly, the number of conducting paths traversing two or more of the boards can be any positive integer: 1, 2, 3, 4, 5, 6, 7, 8, 9, 10, 11, 12, 13, 14, 15, 16, 17-20, 21-30, 31-50, 51-100, or even higher. The number of cross-connections between conducting paths (such as between 112Y and 113Y) can be any natural number: 0, 1, 2, 3, 4, 5, 6, 7, 8, 9, 10, 11, 12, 13, 14, 15, 16, 17-20, 21-30, 31-50, 51-100, or even higher. Although the metallizations on adjacent boards 110 are shown connected to each neighbor by a single electrical connection 120, this is not a requirement: two metallizations on adjacent boards can be connected by any number of electrical connections 120: 1, 2, 3, 4, 5, 6, 7, 8, 9, 10, 11, 12, 13, 14, 15, 16, 17-20, 21-30, 31-50, 51-100, or even higher. They can also be connected by no electrical connections: for example, if metallizations 112X and 113X are connected directly on board 110X, then a conducting path exists from 112X-113X-113Y-112Y, and in some examples, the direct electrical connection between 112X and 112Y can be omitted.

The boards can have properties that are the same, similar, or dissimilar for any property, such as shape, size, thickness, or materials, in any combination. Although FIG. 1 shows a single board at each layer of the stack, this is not a requirement: in examples, there can be two, three, four, or more boards at one or more layers of the stack, in any combination, so long as the antenna structure as a whole has sufficient mechanical integrity.

In some examples, the electrical connections are sufficient to provide mechanical integrity of stacked antenna 100. In other examples, separate mechanical fastenings 130 or 135 are provided. As shown in FIG. 1, each fastening 130 provides a mechanical joint between two adjacent boards 110. The number of mechanical joints between a pair of boards can be any natural number: 0, 1, 2, 3, 4, 5, 6, 7, 8, 9, 10, 11, 12, 13, 14, 15, 16, 17-20, 21-30, 31-50, 51-100, or even higher. As an alternative to pair-wise mechanical joints, a group of boards can be joined together, for example by an external clamp, or a bolt running through the stack and held tight by a nut. Block 135 shows a single mechanical joint attaching to all of the circuit boards.

Mechanical joints and electrical connections can also be formed between any group of contiguous or non-contiguous boards, in any suitable combination. Types of electrical connections and mechanical joints are discussed further below in the context of antenna manufacture. While electrical connections are often low-resistance ohmic connections providing a path over which DC currents can flow, this is not a requirement. Metallizations can also be connected by capacitive or inductive connections. Further a single board can have two disjoint metallizations that are part of single antenna radiator, the two disjoint metallizations being coupled by a capacitive or inductive connection formed either within the board or by one or more discrete components such as capacitors, inductors, or transformers.

As shown in FIG. 1, each conducting path proceeds monotonically in one direction from 112A to 112Z or from 113A to 113Y, but this is not a requirement. An antenna radiator according to the disclosed technologies can have any 3-D path, going up, down, or across, between or along boards in any path, even forming knots, bifurcations, fractal shapes, or other paths difficult to realize with discrete wires, in unlimited variety. Particularly, the disclosed technology can be used for 3-D antennas whose 2-D cross-section varies along its height.

In some examples, adjacent boards are in extensive contact along, for example, the top surface of a lower board and a bottom surface of an upper board, but this is not a requirement: in other examples, one or more pairs of neighboring boards can be separated by a spacer, or held apart in a fixed relationship by any of electrical connections 120 (for example, boards stacked with connectors having finite non-zero height) or mechanical fasteners 130 or 135.

II. Additional Antenna Structure Examples

The stacked antenna 100 can have additional components. In some examples, antenna 100 incorporates a ground plane or ground conductor 146, which can be a solid or flexible conductor, or a board similar to any of boards 110A-110Z, or can even be one of the boards of an antenna stack. Although shown as a single unit, one of ordinary skill in the art will understand that ground plane 146 can have structure: for example, it can be an extensive metallization formed on a non-conducting substrate, or be in the form of a perforated metal sheet or screen. In other examples, the antenna 100 can omit a ground plane, but can instead incorporate one or more ground contacts (not shown).

Stacked antenna 100 can also incorporate a feed. As shown, 142 is a segment of a transmission line (such as microstrip) connecting one antenna radiator at 112A to a feed connection point 144, which can be a coaxial connector or an edge connector. The feed assembly can also incorporate a matching structure comprising reactive circuit elements to match the impedance of the antenna to the impedance of an external source or external transmission line. The matching structure can be fixed or tunable, and can incorporate circuit traces or discrete elements, in any combination.

The boards 110A-110Z can have any suitable shape, such as circular, oval, rectangular, polygonal, or irregular. The boards 110A-110Z can also be of non-convex shape or incorporate one or more cutouts. In particular, antenna 100 can incorporate recesses and cavities that can be partially or wholly enclosed. Cavities and recesses serve to lower the weight of antenna 100, and to reduce the volume of lossy dielectric materials in the antenna 100, thereby increasing efficiency and reducing heating. An internal cavity can be wholly enclosed, or partially enclosed, with at least 30% of its surface area being enclosed, or at least 40%, or at least 50%, or at least 60%, or at least 70%, or at least 80%, or at least 90%, or 100%. A 100% enclosed cavity can have a tortuous or bent ingress path for ventilation or passage of a wire, such that there is no clear line-of-sight between the interior of the cavity and the outside. Alternatively, a 100% enclosed cavity can be sealed. In examples, a bounding surface of a cavity can be metallized, and can form a Faraday shield.

Cavities can also be employed to provide additional components within the antenna volume, on one or more of the boards 110A-110Z. In some examples, discrete electrical components are included in an innovative antenna, and can be used to influence the radiation characteristics of an antenna, for example to change the effective electrical length of a radiator, or can be used for auxiliary functions, such as a signal monitoring detector, diode, or tap. Other auxiliary functions include tamper detection, temperature sensing, and illumination such as a warning light. Some electrical components require power and can require signal connections also. Power and signal connections can be provided using metallizations on one or more of the antenna boards, or by a separate cable or wiring, in any combination.

In some examples, the edge or edges of a board are close to vertical, or perpendicular to top or bottom surfaces of a board, while in other examples edges can be slanted. Slanted edges can provide different or superior performance compared to vertical edges. Slant angles measured from a top or bottom surface can be in the (inclusive) ranges of 75°-89°, 60°-75°, 45°-60°, 30°-45°, 15°-30°, or 1°-15°.

In some examples, an antenna can include multiple stacked three-dimensional antennas of same or different configurations. In other examples, a hybrid antenna can include at least one stacked three-dimensional antenna together with one or more antenna modules of a different design. In certain examples, an antenna array incorporates an assembly of individual three-dimensional antennas mounted on a common base or support structure, while in other examples, an antenna array includes two or more stacked board antennas sharing one, two, or more planar wiring boards.

Antenna 100 can also incorporate additional trimming or tuning elements to facilitate trimming or tuning procedures to be performed during or after antenna manufacture.

III. Illustrations of an Example Antenna

FIGS. 2A-2L are top-view illustrations of 12 individual planar wiring boards 410A-410L used to form an example antenna 400. The bottom-most of the 12 boards is board 410A, and the boards are depicted in stacked order, with board 410L being the top-most board. Each top-view illustration FIGS. 2A-2L shows non-conducting substrate areas unshaded, and conductive metallizations shaded with a cross-hatch pattern. Dotted lines are used to indicate an outline of where a next board in the stack can be seated on each board. For example, the dotted line in FIG. 2G indicates where board 410H can be placed atop board 410G.

Collectively, the boards 410A-410L have been designed to fill and form a hemisphere. The boards 410A-410L also have edge metallizations in approximately the same angular positions as the top surface metallizations. Thus an antenna radiator can be formed by an alternating series of top-surface metallizations and edge metallizations when the stacked antenna is assembled.

Because the intended assembled shape is a hemisphere, the surface slope near the base (bottom) of the hemisphere is steep, and there is very little radius difference between adjacent boards near the bottom of the stack. Because a function of the top-surface metallizations is to connect two edge surface metallizations of neighboring boards, and the neighboring boards at the bottom of the stack have very similar radii, the radial extent of top-surface metallization near the bottom of the stack (e.g. boards 410A-410C) is small. Moving up the stack, the surface slope of the hemisphere turns towards the horizontal, the radial difference between adjacent boards increases, and the radial extent of top-surface metallizations increases correspondingly. Thus, the top surface metallizations can be more clearly seen for smaller boards that are higher up in the stack of antenna 400.

Figure 3A:
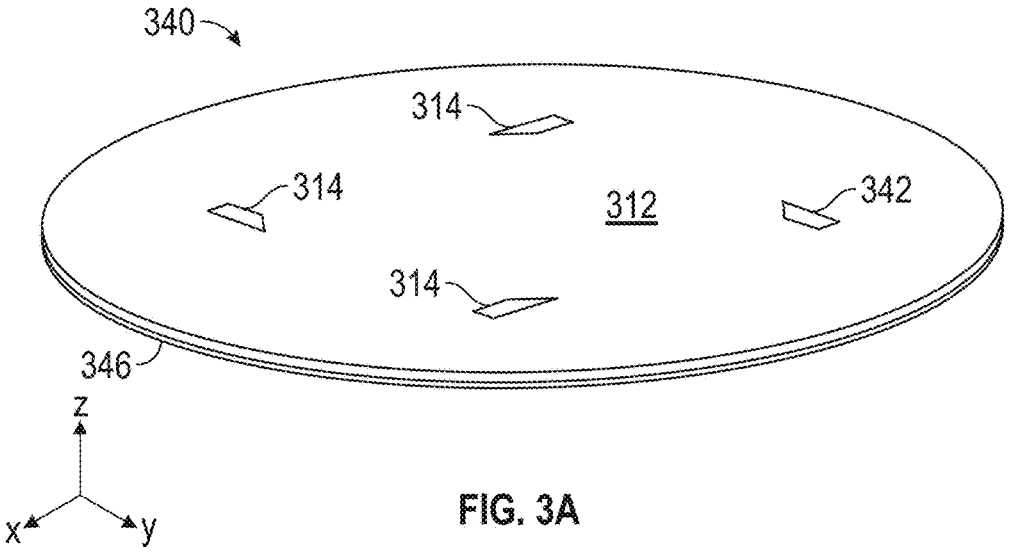
FIGS. 3A-3C are views of a base board on which an example hemispherical antenna can be mounted.
Figure 3B:
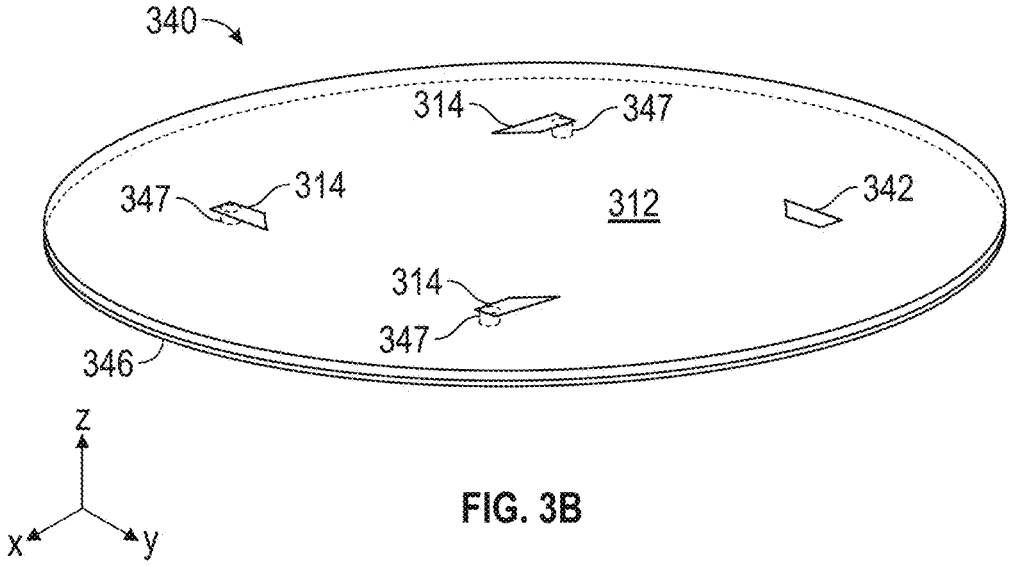
Figure 3C:
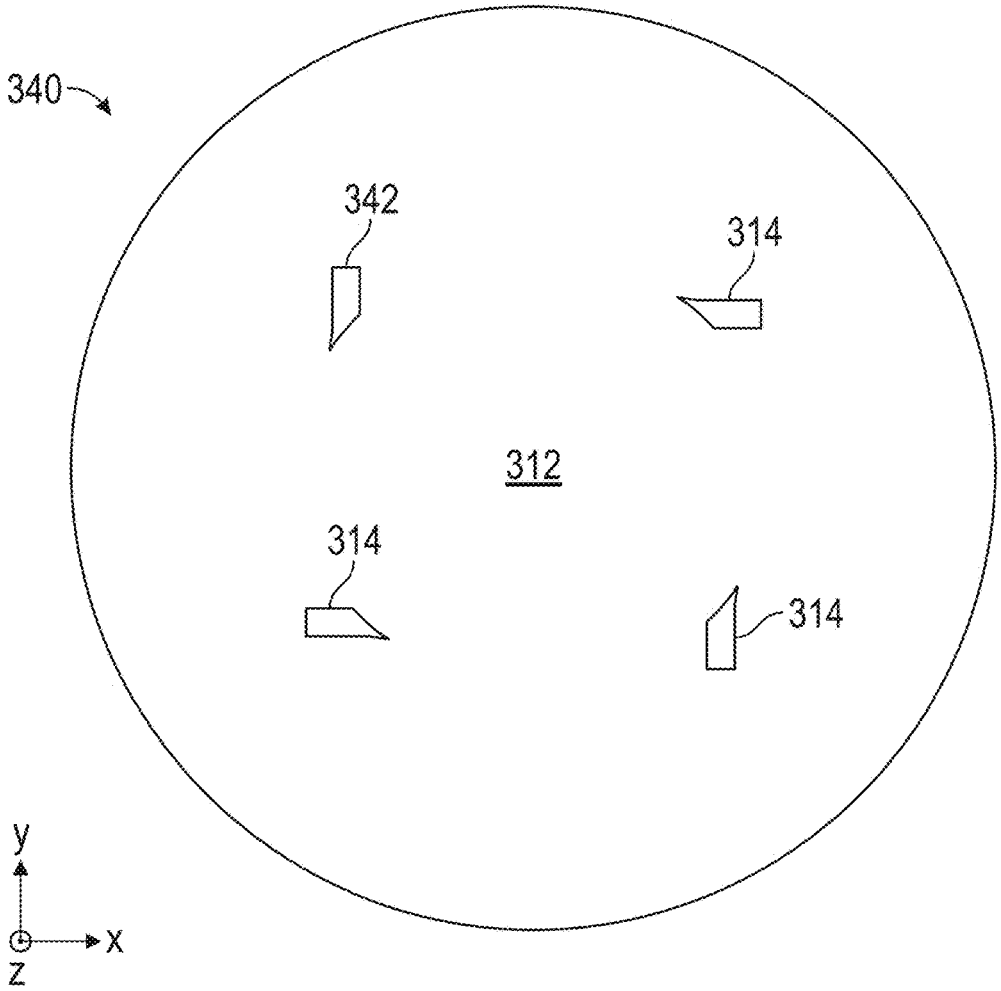

FIGS. 3A-3C are illustrations of a base board 340 on which the board stack 410A-410L can be mounted. In some examples, base board 340 is part of antenna 400, while in other examples, an antenna can be mounted on a separate base board 340 or on equivalent structures formed on a motherboard that may house other circuitry of a radio or other host product. As shown in FIG. 3A, base board 340 is formed of a substrate 312 having a bottom-side metallization 346. The base board also has top surface metallizations including antenna feed 342 and three terminals 314. In an example, the top surface metallizations 342 and 314 are intended to attach to the four radiator arms of a helical antenna. Other similar designs can be used for base boards of other antenna designs.

FIG. 3B is a see-through view of base board 340, showing the same components and structures as FIG. 3A, and also showing plated through-hole (PTH) vias 347 forming ground contacts from each terminal metallization 314 to the ground plane 346. FIG. 3C is a top view of base board 340, showing some of the components and structures of FIG. 3A.

Figure 4A:
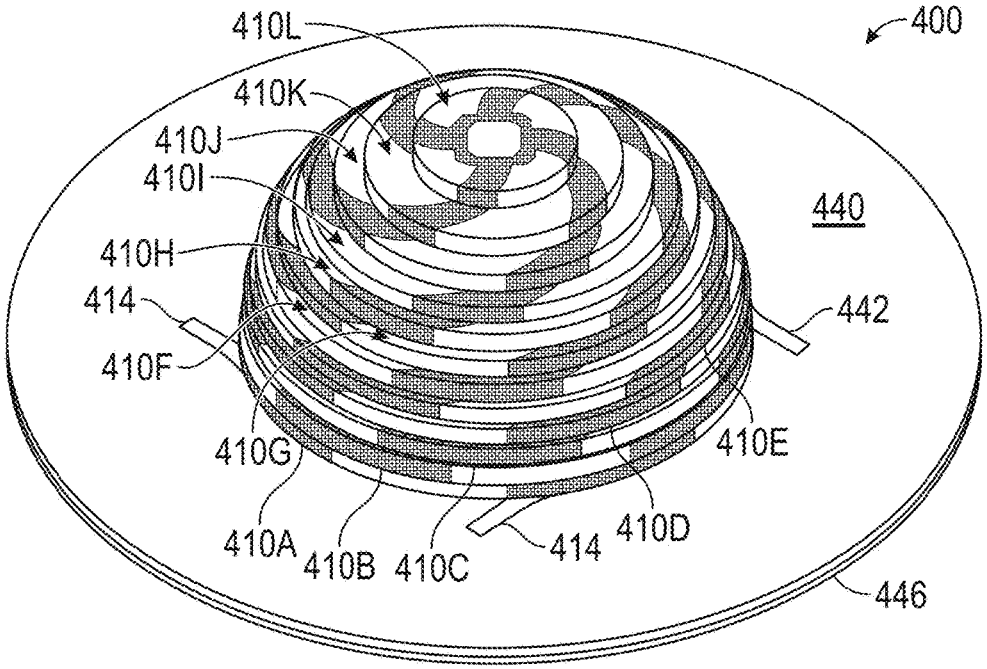
FIGS. 4A-4B depict an assembled antenna in oblique view and top view, respectively.
Figure 4B:
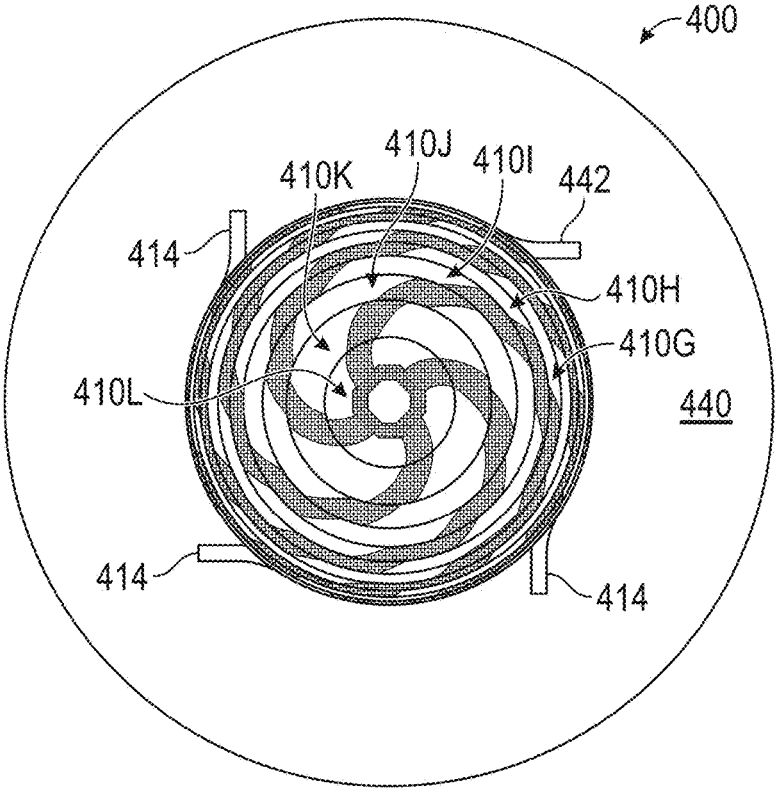

FIGS. 4A-4B are illustrations of assembled antenna 400 including a stack of PCBs 410A-410L and mounted on base board 440. FIGS. 4A-4B show antenna 400 in oblique view and top view respectively. The antenna 400 is mounted on a base board 440 having a bottom side ground plane 446 similar to 346. While a circular base board 440 is illustrated, other shapes can be used. On the top surface of the base board 440 are one antenna feed 442 and three terminals 414 for ground connections (PTH vias not shown). Above the base board is a stack of 12 circular PCBs 410A-410L forming a hemisphere. The PCBs have a substrate (unshaded) and metallizations (shaded) for four arms or radiators that approximate an idealized wire helix. The four arms are joined in a ring on the top surface of PCB 410L.

Figure 5:
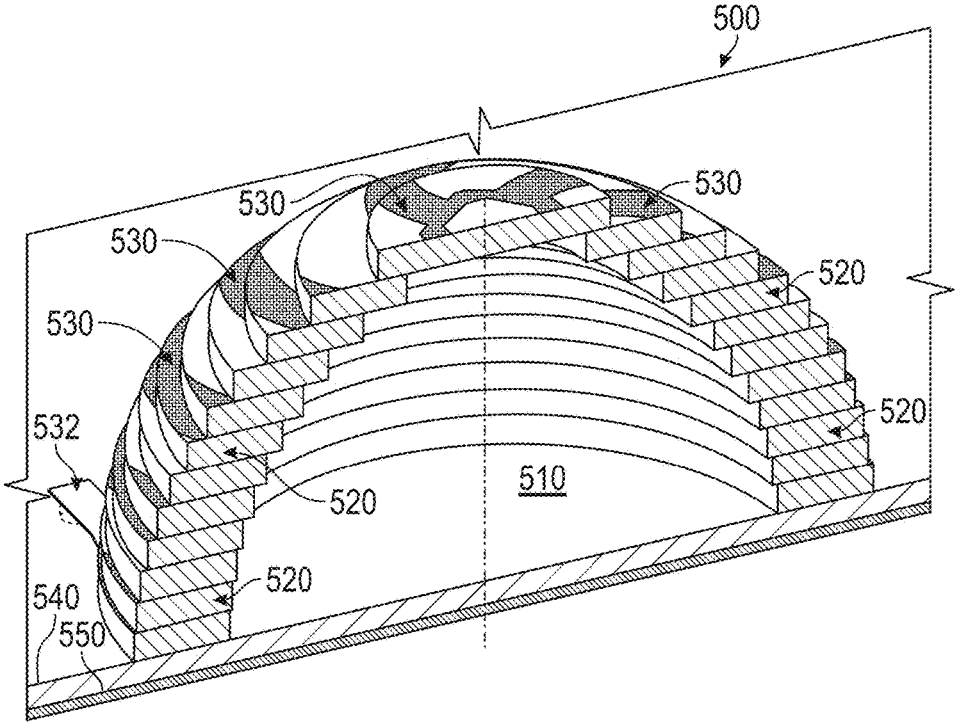
FIG. 5 is an oblique cutaway view of an example three-dimensional antenna incorporating a cavity.

FIG. 5 is an oblique cutaway view of an example three-dimensional antenna 500 incorporating a cavity 510. An assembled stack of PCBs is shown, having dielectric substrates 520 and metallized helical radiators 530. Interior cutouts on multiple PCBs form the cavity 510. The assembled stack of PCBs is located above a top surface of dielectric mounting substrate 540 having a ground plane 550 on its bottom surface. Feed connection 532 is also shown.

Figure 6:
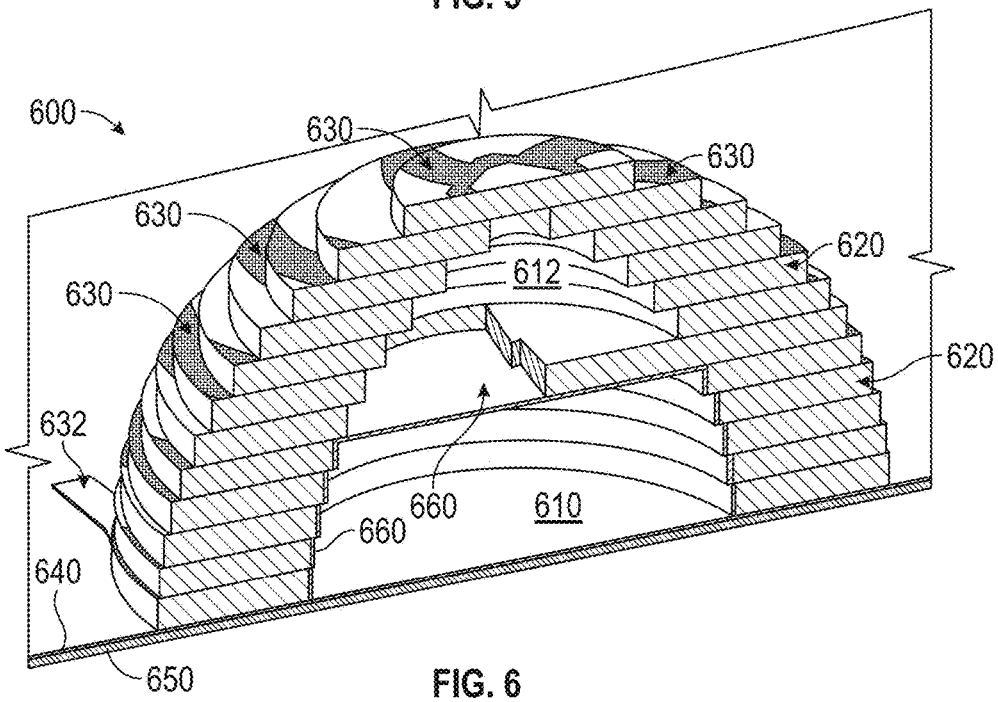
FIG. 6 is an oblique cutaway view of an example three-dimensional antenna incorporating two cavities and a Faraday shield.

FIG. 6 is an oblique cutaway view of an example three-dimensional antenna 600 incorporating two cavities 610, 612. The assembled stack of PCBs, having dielectric substrates 620 and metallized helical radiators 630, is similar to those of FIG. 5. Copper metallization 660 on interior surfaces of cavity 610 forms a Faraday shield. The Faraday shield allows for the electrical isolation of the antenna and internal components (e.g. application-specific integrated circuits, silicon dies). A portion of the PCB immediately above the uppermost metallization layer of the Faraday shield has been further cut away for purpose of illustration. The antenna 600 is formed on a dielectric mounting substrate 650 having a top-side ground plane 640. Feed connection 632 is also shown.

For clarity of illustration, exposed surfaces of 632, 640, 660 in FIG. 6, as well as 414, 442 in FIGS. 4 and 532 in FIG. 5, are shown unshaded; in examples, any of these could be copper metallization.

IV. Example Antenna Manufacturing Process

Figure 7:
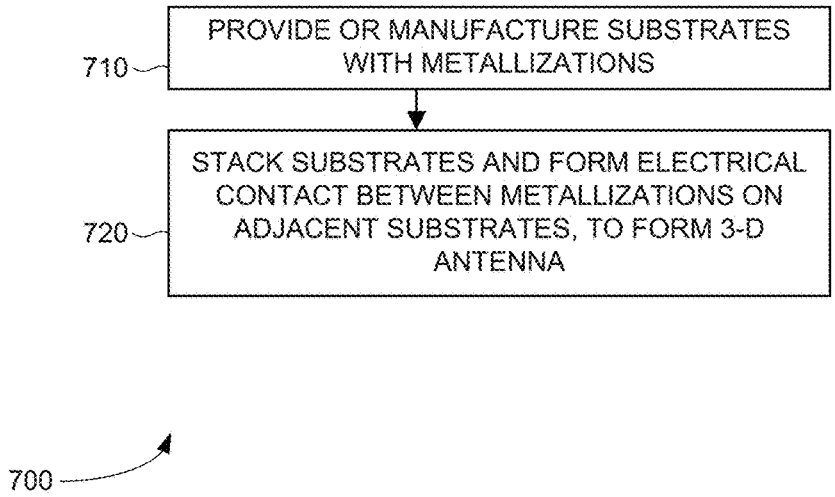
FIG. 7 is a flowchart outlining an example method of manufacturing an antenna, as can be performed in certain examples of the disclosed technology.

FIG. 7 is a flowchart outlining an example method of manufacturing an antenna, as can be performed in certain examples of the disclosed technology.

At process block 710, metallized substrates are provided for assembly. The substrates can be manufactured in a variety of ways depending on antenna size, manufacturing volume, cost and weight requirements, and target operating frequencies and performance requirements. The performance requirements and operating frequencies can influence the choice of materials, some available materials being too lossy for a particular application, and can influence the choice of mechanical or metallization process, some processes having unacceptable mechanical tolerances for a particular application.

In common examples, substrates are manufactured through one- or two-layer printed circuit board (PCB) processes as are known in the art. Dielectric substrate materials can be chosen from among FR-4 or another fiber resin composite, RO3003 or another ceramic filled polytetraflouroethylene (PTFE, Teflon™) composite, polyoxybenzylmethylenglycolanhydride (e.g. Bakelite), polyimide (e.g. Kapton®), or another substrate material. In some processes, metallization is formed on a PCB by an additive metallization process (for example, screen printing or selective copper plating), while in other processes metal-clad substrates are used as a starting material, and desired metallization shapes are formed by a subtractive process, commonly photolithographic. In other processes, a hybrid or semi-additive technique is used, where a metal-clad board having a thin metal cladding is first etched into the desired patterns, and then the metal thickness is grown (to reduce the surface resistivity) by electroplating. Metallizations can be formed on one or both of top and bottom surfaces of a wiring board, and also on interior or exterior vertical surfaces as discussed further below. In many examples, metallization is copper, but other metals and non-metallic conductors can be used in any combination; even with copper metallization, barrier layers and coating layers can incorporate other materials such as nickel, tin, aluminum, a solder alloy, or gold. Substrates can have one or more disjoint metallizations on the same or different surfaces. The disclosed technologies are not limited to one- or two-layer PCBs: multi-layer PCBs can also be employed, with metallization on any of the layers. In other examples, a multi-chip module according to the disclosed technology comprises two or more stacked PCBs. In some examples, a multi-chip module comprises two or more stacked boards including at least one board fashioned from a ceramic or other suitable insulating material.

Electroplating can be performed in any process to increase metallization thickness. A finishing coating procedure can also be formed on the metallization, including hot-air solder leveling (HASL, with either leaded or lead-free solders), immersion tin, organic solderability preservative (OSP), electroless nickel immersion gold (ENIG), or hard electrolytic gold (over a nickel barrier coat). In some applications, bare copper can be used, and/or a coating finish can be applied to the assembled stack antenna. In some examples, a further coating such as a solder mask can be selectively applied over the finished metal coating to provide additional protection against wear, oxidation, and corrosion.

In order to enable electrical connection between boards, it can be desirable to extend a metallization on, for example, a top surface of one planar wiring board, to an opposite bottom surface. This can be accomplished with a combination of at least one or more of the following: plated through-hole vias (PTH) (solid or annular), by edge wrap-around terminals, by plating a machined slot of straight, curved, segmented, or irregular shape, including optionally cutting off unneeded outer portions of the substrate before or after plating, or by other techniques. Edge wrap-around terminals can be formed by a photolithographic process similar to that used for surface metallization, or by adhesive attachment of a wrap-around copper foil. In some examples, the top surface is electrically connected to the opposite bottom surface using one or more buried vias for a portion of the electrical path.

In order to facilitate accurate alignment and positioning of boards in subsequent assembly process, alignment marks or features can be formed on each board. The marks can be of the same material as the metallization or of a non-conducting material such as ink or paint. The features can be mechanical features such as holes, notches, grooves, bumps, or ridges. In some examples, an additive feature such as a bump or pin can be formed on one board can be situated to mate with a corresponding subtractive feature such as a hole on a neighboring board for ease of subsequent alignment and assembly.

Use of PCB technology is not a requirement of the disclosed innovations. In some examples, the planar wiring boards can be semiconductor dies, with metallizations formed by wafer processes such as are known in the art, and the assembled antenna stack has a structure analogous to a 3-D chip. The semiconductor dies can be connected by through-silicon vias or silicon bridges, in some examples. In other examples, larger antennas can be formed using thicker substrate materials including sheets, rectangular tubes, extrusions, honeycomb structures, or frameworks of composite, polymer, ceramic, wood, or cellulose materials, in any combination. Metallizations can be formed by adhesive or fastener attachment of metal foils or sheets, or by screen printing.

At process block 720, the metallized substrates are electrically and mechanically joined to form a stack assembly. The joining may be performed in various different workflows, using various different joining technologies. In certain examples, the joining process is begun by taking a largest one of the planar wiring boards and joining it to one of its neighbors (if the largest planar wiring board is a bottommost board in the stack, then it may have only one neighboring board). This joining process proceeds by successively attaching one more board to the partially assembled stack until the entire stack is formed. With the stacking, electrically conductive contacts are formed between each metallization and one or more disjoint metallizations on adjacent substrate(s).

Each attaching procedure may incorporate a plurality of sequential or concurrent actions. These actions can include aligning the boards or subassemblies to be joined in a predetermined relationship. This positioning can be facilitated by alignment marks on one or more of the boards, or by a jig into which the boards or subassemblies can be positioned in only a unique, predetermined, or aligned way, or by numerical programming of a pick-and-place machine or other robotic equipment. Other actions are the forming of a permanent electrical connection and the forming of a permanent mechanical contact.

Here, the word "permanent" is used to differentiate the desired electrical connection, dubbed permanent, from casual electrical contact that can occur when two electrically conducting objects (such as metallizations on planar wiring boards) are placed in temporary physical contact with each other. Similarly, a desired permanent mechanical joint is differentiated from a temporary joint that can be formed clamping two or more boards together to hold them in a desired relative position, or to avoid shifting during formation of joints and contacts. The word "permanent" as used in this disclosure does not imply any particular level of durability or longevity. For example, a permanent mechanical contact can be made with a nut and bolt (in some examples, a non-conducting bolt, or a bolt of a material having dielectric constant matching the dielectric constant of a substrate material of the planar wiring boards) and can easily be undone with, or even without, simple hand tools. A permanent mechanical joint is characterized by providing mechanical rigidity of a finished antenna or a consistent spatial relationship between two or more of the constituent boards. A permanent electrical connection is characterized by defining low-impedance paths over which electric currents flow between metallizations of proximate boards when the antenna is in operation. Generally, in this disclosure, the terms "electrical connection" and "mechanical joint" are understood to mean permanent electrical connection and permanent mechanical joint, unless they are used in some context other than a stacked antenna, or unless a different meaning is clear from the context.

In certain examples, permanent electrical connections and permanent mechanical joints are formed together, such as by soldering the metallizations of two wiring boards together, by use of a conductive adhesive, or by use of electrically conducting fasteners such as connectors, headers, standoffs, pins, clips, or bolts. A bolt through multiple boards can provide sufficient compressive force to enable good electrical contact between adjacent metallizations of neighboring boards, and can be used in conjunction with toothed washers between the boards.

In other examples, relatively weak solder joints between narrow metallizations prone to peeling cannot be relied upon as mechanical joints. Examples of relatively weak electrical connections also include wire bonding and cables. In such cases a strong mechanical fastening can be used, for example adhesive, a clamping fixture, a fastener, potting or encapsulation of an assembled stack, or welding including welding of metal fitments or plastic welding. Where electrical connections and mechanical joints are formed separately, they can be formed in any suitable order.

Above, an example joining process was described as sequentially attaching one board at a time to a partially assembled stack. Other workflows can also be followed. For example, boards can be attached in pairs, for example board 1 to board 2, board 3 to board 4, and so on, to obtain N/2 subassemblies from N boards. Following this, two pairs can be joined to form quads, such as boards 1-4, boards 5-8 and so on. In this way, the number of sub-process can be reduced from N−1 (for one-by-one attachment) to approximately $\log_2(N)$, which can be advantageous in joining processes where curing time is a consideration.

Another workflow can involve joining more than two boards in the stack (even, all boards) in a single operation, for example bolting the stack together through one or more aligned through holes. In such a workflow, the permanent mechanical joint is formed first, followed by forming the permanent electrical joints, either sequentially by manual soldering, or simultaneously by IR reflow soldering in an oven. In other workflows, the bolts are used for temporary mechanical attachment and can be removed after soldering: in instances where the solder joints and metallizations have sufficient mechanical strength and peel resistance, or in instances where permanent mechanical attachment is formed by potting the entire assembled antenna.

Other actions in one or both of the forming process or the board manufacture process can include preparation procedures or finishing procedures. Preparation procedures can include mechanical steps such as drilling holes for fasteners, positioning within a jig, clamping two or more boards together, or mechanical surface cleaning with an abrasive. Preparation procedures can include chemical procedures such as chemical polishing, or etching. Preparation procedures can include material application procedures such as coating with a protective layer, a mask layer, or a photoresist, or can include other photolithography steps. Preparation procedures can include material removal procedures such as selective removal of a non-conducting coating over metallization areas required to form electrical connections, or trimming of a board shape.

Finishing procedures can include cleaning, coating, and removal of residues.

V. Additional Antenna Manufacturing Process Examples

A number of variations and additional actions can be employed of as part of an antenna manufacturing process according to the disclosed technologies.

In some examples, one or more ground contacts are formed on one or more of the planar wiring boards, either during board manufacture, after assembly of the board stack, or at any intermediate stage. Ground contacts can be as simple as an exposed metallization area for mechanical or solder contact with an external ground conductor, or can include electrical and/or mechanical fittings such as holes, plated holes, connectors, wiring receptacles, or lugs. In some examples, one or more ground contacts extend along at least 50%, at least 75%, at least 95%, or 100% of a perimeter of a board stack, in order to facilitate a low inductance or (for the 100% case) sealable connection to a ground plane. Ground contacts are commonly formed on a bottom board of a stack, or on a board having the largest area among the boards, or on a single board among a stack, but none of these are requirements of the disclosed technologies. An inverted cone antenna design can have a ground connection at the apex, or ground can be attached at multiple levels of an antenna stack.

In some examples, one or more feeds are formed on one or more of the wiring boards. A feed can include a transmission line component, such as a microstrip section, tunable or fixed impedance matching elements, and a coupling point. The coupling point can be a connector for providing an ohmic connection between the antenna feed and an external feeding device or external transmission line. For example, the coupling point can be a coaxial connector for attachment of a coaxial cable. The coupling point can alternatively provide capacitive or inductive coupling from an external line or device. Commonly, 50-ohm impedance lines are used to feed the antenna, but any other impedance including 50-55Ω, 75Ω, 93Ω, 300Ω, or 450Ω can be used.

In some examples, manufacture can include attachment of a ground plane to the board stack. The ground plane can be in the form of another planar wiring board, or a metal sheet or screen, or another electrically conductive structure.

One or more discrete electrical components can be attached, before, during, or after assembly of a stack, for functions earlier described. Particularly, components can be located in an interior cavity of an antenna, or on an external shelf.

In some examples, one or more cavities are formed within a board stack. For example, one or more of the individual wiring boards can be formed with a cutout, or in an annular shape, or in a C-shape. Cavities can also be formed during or after assembly of the boards into a stack.

In some examples, neighboring boards can be placed in direct and extensive mechanical contact, while in other examples, spacers can be included between boards while forming a board stack. Spacers can be conductive or non-conductive. Any combination of direct contact, conductive spacers, and non-conductive spacers can be used.

In some examples, the antenna can be electrically tuned or trimmed after assembly of the stack. Tuning or trimming can be performed by mounting the antenna in a test fixture, attaching a source such as a tunable oscillator, attaching a measurement instrument such as a VSWR meter or a loop detector, and then making adjustments to the antenna in order to obtain desired performance. The desired performance can be specified by any of a range of parameters, including without limitation: resonant frequency, impedance match, reflection coefficient, bandwidth, directivity, radiation pattern, or radiative efficiency, in any combination. Performance parameters can be specified at a spot frequency, at a set of discrete frequencies, or over one or more frequency bands, in any combination.

Adjustments can be mechanical adjustments, such as adjusting a spacing between a board stack and a ground plane, adjusting the geometry of an antenna radiator, adjusting a conductor length, adjusting spacing or relative transverse positioning between boards, or rotating one board relative to another. Adjustments can be electrical, such as cutting or partially removing a conductor on one or more of the wiring boards, or adjusting a tuning screw or trimmable discrete element. Adjustments can include adding conductive traces or electrical components, such as a gimmick loop. Adjustment can include disassembly, swapping a new wiring board or other component for a previous board or component, and reassembly of the antenna stack.

In some examples, manufacture of the wiring boards can include forming a trimmable metallization shape on one or more of the boards.

In various examples, a photolithographic process can include cleaning, surface preparation, photoresist application, light or UV exposure, etching, or photoresist removal. A board manufacturing process can also include lamination, laser resist ablation, milling, photoengraving, or plating.

In examples where the boards include semiconductor dice, stack assembly can include one or more of a chip stacking procedure, die-to-die bonding, die-to-wafer bonding, or wafer-to-wafer bonding.

VI. Example Antenna Design Process

Figure 8:
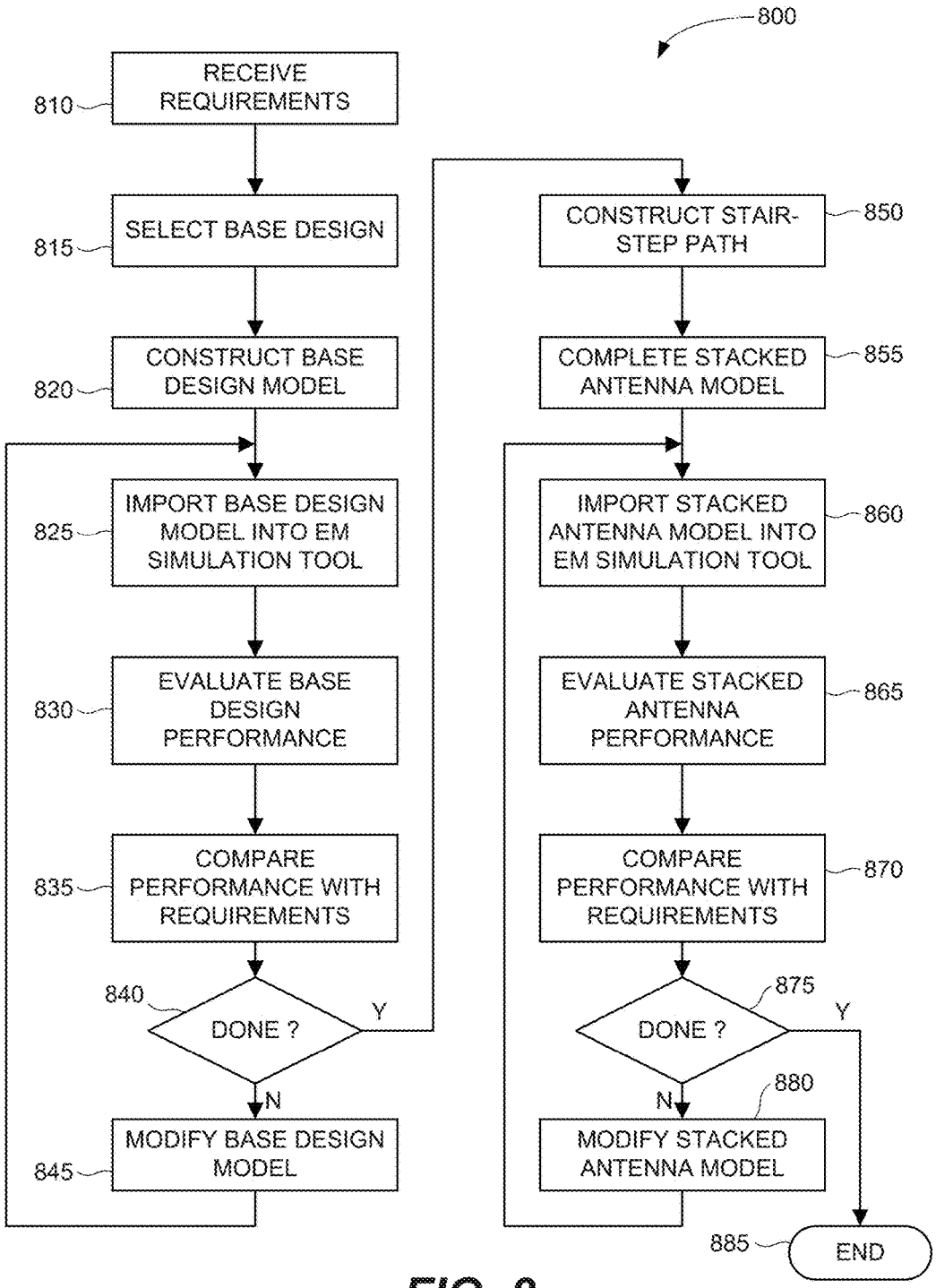
FIG. 8 is a flowchart outlining an example method of designing a stacked antenna, as can be performed in certain examples of the disclosed technology.

FIG. 8 is a flowchart outlining an example antenna design process 800. At process block 810 a set of design requirements and/or guidelines can be received. For example, a requirement can be a bandwidth of 2 MHz at an operating frequency of 900 MHz with losses under 20%, a directivity threshold, and a maximum intensity variation of the far-field over a range of azimuthal directions. A requirement can also include a cost target. A selection of a base design topology can be made at process block 815. A base design topology can be a hemispherical helical antenna with four arms and a single feed.

At process block 820, a model of the base design can be constructed using a solid modeling software tool such as SolidWorks™. At process block 825, the model can be transferred to an electromagnetic simulation software tool having an antenna analysis package, such as SEMCAD X Matterhorn™. At process block 830, performance of the base design can be evaluated using the electromagnetic simulation software tool. The performance can be compared with requirements at process block 835. If the results are satisfactory, a determination can be made at process block 840 that this stage is complete, otherwise, the base design can be adjusted at process block 845, and process blocks 825 to 840 can be repeated.

Following successful evaluation of a base design, a solid model of a stacked board design can be constructed using the solid modeling software tool. First, a notional stair-step conducting path can be constructed at process block 850 to approximate the antenna radiators of the base design. The horizontal portions of the stair-step path correspond to horizontal surface metallizations on a surface of a printed wiring board, while vertical portions correspond to edge metallization in the form of wrap-around terminals or in another form. The stair-step path can be determined using a sampling of points from the antenna radiators of the base design. The stair-step path can be augmented, for example with additional metallization areas to form solder pads. A metric can be used to assess the deviation of the stair-step path or the augmented path from the base design. For example, the metric can be an area of a minimal surface (e.g., a soap film) connecting the stair-step path and the conductor of the base design. Adjustments to the metric can be made for the finite width of the conductors, for impedance effects at corners, or for augmented conducting features. The stair-step path can be constrained by one or more desired board thicknesses; alternatively, board thicknesses can be varied as a design parameter.

At process block 855, the augmented stair-step path can be fleshed out as a complete solid model, including substrate material selection and outlines of the boards, widths and thicknesses of metallizations, and any other features such as feeds, fittings, holes, or additional components. Commonly, the metallization can be modeled as copper, but other metals and non-metallic conductors can be used. At process block 860, the solid model can be transferred to the electromagnetic software simulation tool. Process blocks 865, 870, and 875 evaluate the stacked design, compare its performance with requirements, and make a determination whether this stage is complete. If the results are not satisfactory, the method can return to modify the stair-step path and/or other features of the stacked antenna model at process block 880. In some circumstances, the method can return to process block 815 to try a different base design, or even process block 810 if there is a possibility of relaxing the requirements.

If the process is found to be complete at process block 875, then the antenna design method terminates at process block 885.

VII. Additional Antenna Design Process Examples

In certain examples, the thickness and outline of each PCB within the stack can be adjusted to optimally match the desired three dimensional geometry of antenna radiating elements.

In some examples, multiple sets of requirements can be used. A first set of requirements can pertain to the tested operating characteristics of a manufactured product, a second set of requirements can pertain to the design testing of the stacked board antenna, and a third set of requirements can pertain to the design testing of a base design. The difference between first and second sets of requirements can be chosen to allow for materials variance and manufacturing variance. The difference between the second and third sets of requirements reflects that a realizable board stack antenna only approximates an idealized base design. In some examples, the first set of requirements can be a starting point, which can be tightened based on expected variations to obtain the second set, following which the third set can be obtained based on material properties and realizable conductor shapes.

VIII. Example Antenna Models

Comparative Hemispherical Helical Wire Antenna

Figure 9:
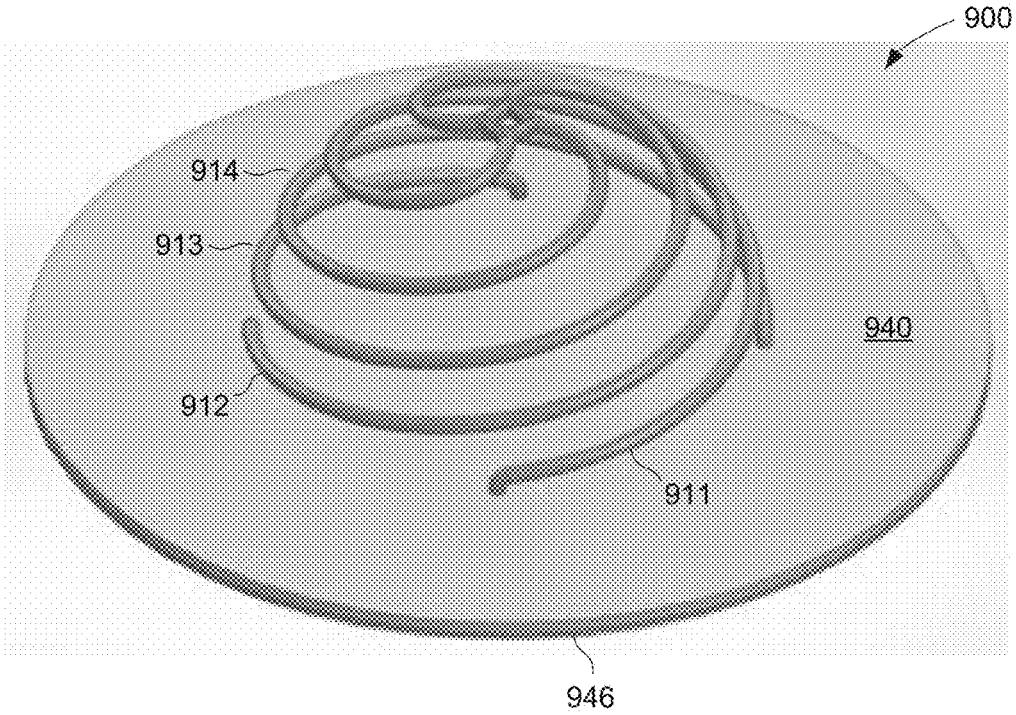
FIG. 9 depicts a comparative hemispherical helical antenna, in which each arm is formed integrally as a solid wire.

FIG. 9 depicts a comparative hemispherical helical antenna 900, in which each arm (or, antenna radiator) 911-914 is formed integrally as a solid wire. The four-arm hemispherical helix antenna 900 has radius 19.1 mm and was designed using copper wire conductors having a radius of 1.25 mm. The four arms meet at their top ends, at the apex of the hemisphere. The antenna 900 is mounted on a base board 940 having a continuous bottom-side ground plane 946. The antenna feed (not shown), at a bottom end of one of the four arms, was modeled as being connected directly to a 50 ohm source. The bottom ends of the other three arms were shorted to ground 946.

First Example PCB Antenna Structure According to the Disclosed Technology

FIGS. 4A-4B depict an assembled antenna 400, in oblique view and top view respectively. The assembled antenna 400 uses twelve PCBs, having FR-4 dielectric and a thickness of 1.575 mm each. The radius of each PCB was chosen to approximately conform to the 19.1 mm radius hemispherical volume of the comparative antenna of FIG. 5. Curvilinear copper traces were placed on a top surface of each PCB having a width not exceeding the wire circumference. Viewed from above, the curvilinear traces follow the same spiral as the wires of Example 1. The curved edge surfaces of all PCBs except the bottom-most PCB were also partially metallized to provide an electrically continuous path to the next lower PCB. Four arms of a spiral were thus formed in segments spanning the twelve PCBs. On the topmost PCB, the four arms join together near the apex of the imaginary hemispherical enclosure. On the bottom-most PCB, three of the arms are shorted to ground, while the fourth arm provides an antenna feed from a 50 ohm source.

Second Example PCB Antenna Structure According to the Disclosed Technology

As another example, an antenna structure was designed using PCBs with Rogers RO3003 substrate material, but otherwise identical to the design described above regarding FIGS. 4A-4B. Both examples use copper metallization having a conductivity of $5.813\times10^7$ Siemens per meter.

The mechanical structure can be designed using any of a variety of solid modeling, CAD/CAE software packages, including: SolidWorks™, AutoCad™, Inventor™, Alibre™ Draftsight™, Fusion360™, Rhino3D™, or Google SketchUp™. Some EM simulation tools also incorporate mechanical modeling capability and can be used to design an antenna model. Table I shows common properties of the three Example designs.

TABLE I

ANTENNA SPECIFICATIONS FOR THE FOUR-ARM HEMISPHERICAL WIRE ANTENNA

| Number of Turns | Antenna Radius (mm) | Ground Plan Radius (mm) | Target Frequency (MHz) |
|---|---|---|---|
| 1 | 19.1 | 36 | 950 |

One turn means that each arm rotates 360° about a vertical axis of the hemisphere from the base of the antenna to the apex. The antenna radius is the radius of the hemisphere. The antennas were designed to operate placed over a finite ground plane having 36 mm radius, and were designed to have a target operating frequency of 950 MHz. The Example designs were tuned by adjusting the spacing between the base of the antenna and the ground plane.

IX. Example Performance Evaluation

Following mechanical design, the antenna structure for any of the models can be exported to a field solver to analyze the antenna properties by simulation. SEMCAD X Matterhorn™ is a full-field solver with antenna analysis capabilities; other field solvers can also be used, such as Comsol MultiPhysics™, emGine Environment™, HFSS™, HyperLynx™, or JCMwave™.

Antennas were compared based on radiation pattern, reflection coefficient, and efficiency. Table II shows simulation results for the wire antenna of FIG. 5 ("Wire"), the First Example of FIGS. 4A-4B ("PCB—FR4"), and the Second Example of FIGS. 4A-4B ("PCB—RO3003").

TABLE II

SIMULATED RESONANT FREQUENCY AND RADIATION EFFICIENCY

| Antenna | Resonant Frequency (MHz) | Radiation Efficiency (%) |
|---|---|---|
| Wire | 995 | 99 |
| PCB - FR4 | 683 | 36 |
| PCB - RO3003 | 746 | 81 |

Factors believed to affect the variation in parameters between the Examples include dielectric loading of the antenna elements, due to the higher relative permittivities of the PCB substrates as compared to the air of the wire antenna, loss tangents of the dielectric materials, and longer antenna segment length as the copper traces meander relative to the ideal helical path.

Example Experimental Results

Figure 10:
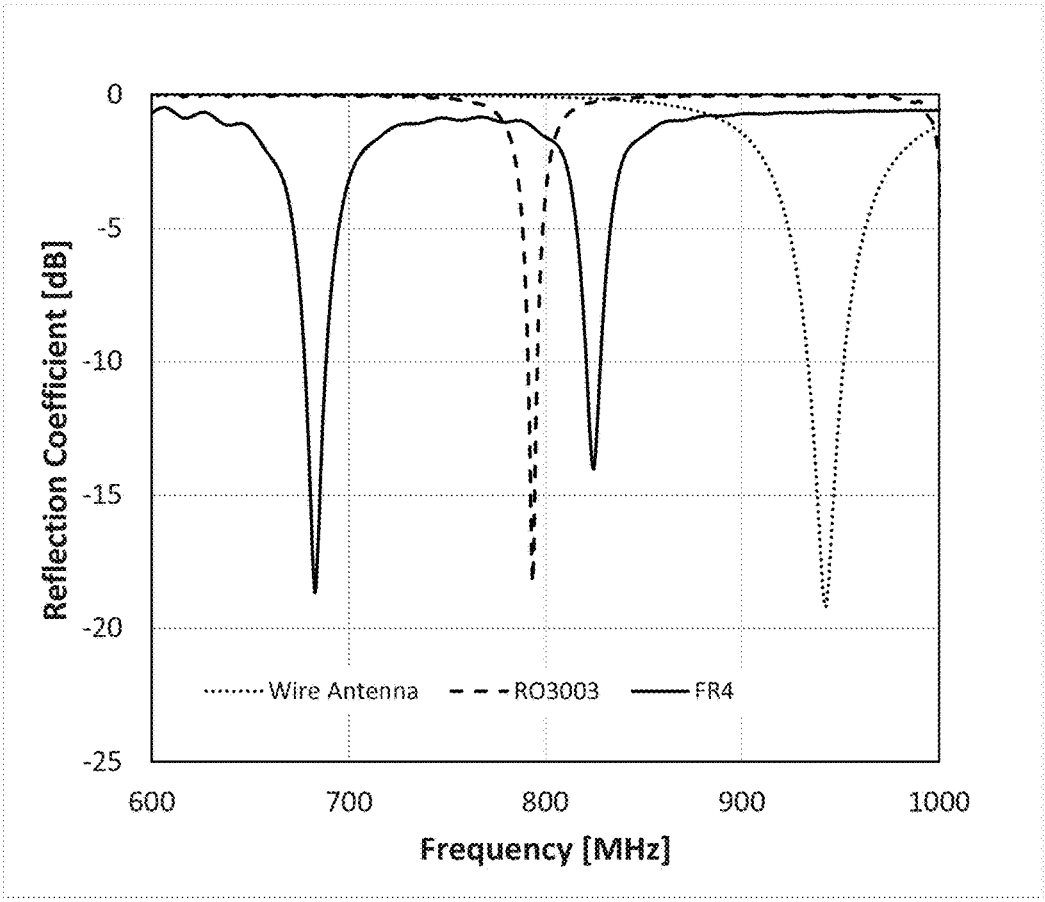
FIG. 10 is a chart depicting a comparison of reflection coefficients of three example hemispherical helical antennas.

FIG. 10 depicts a comparison of reflection coefficients of three antennas according to the wire example and the first and second PCB examples. The dotted line represents a comparative solid-wire antenna. The solid line represents the first example stacked antenna built with FR4 PCBs. The dashed line represents the second example stacked antenna built with RO3003 PCBs. With reflection coefficients around −18 dB for each of the three antennas, it can be seen that the antennas are well-matched at and near their resonant frequencies.

Figure 11:
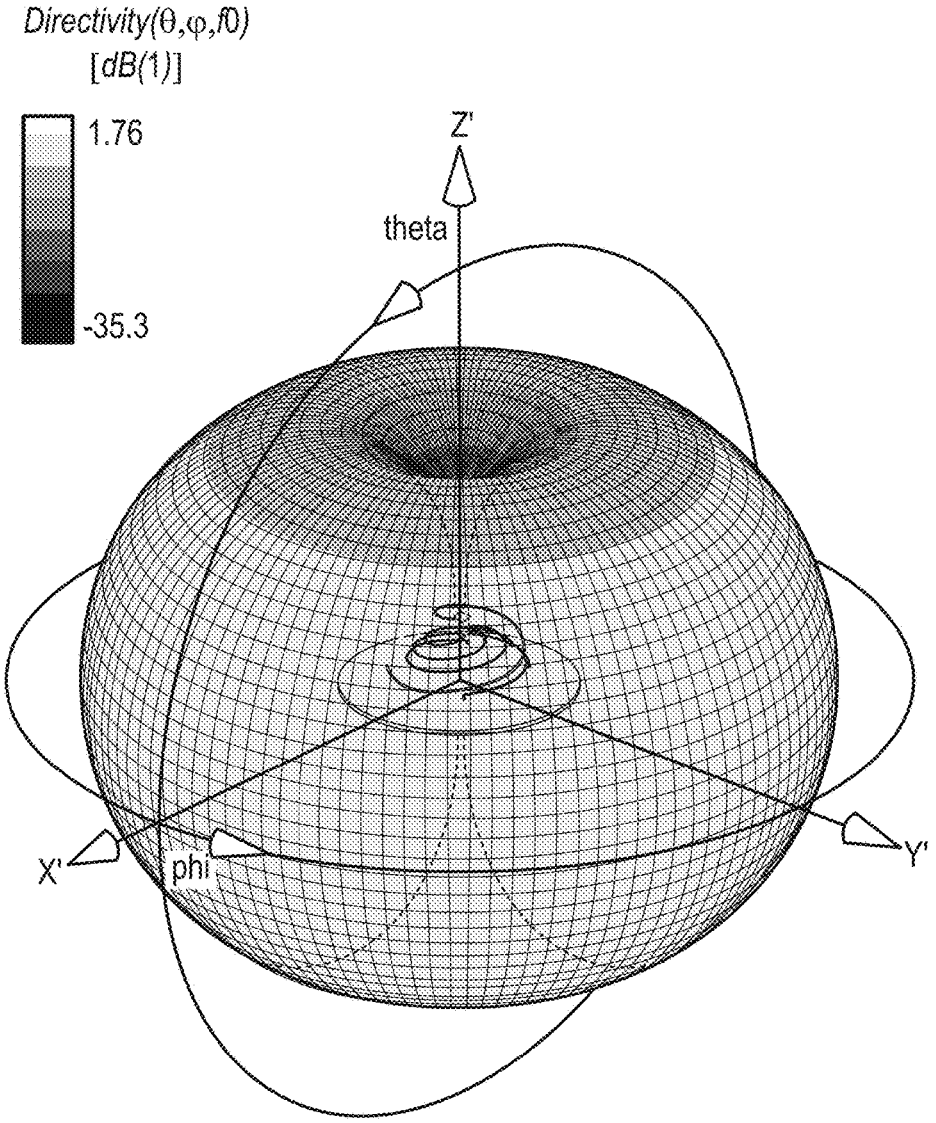
FIG. 11 is a three-dimensional plot of radiated power density over solid angle, for a comparative hemispherical wire helix antenna.
Figure 12:
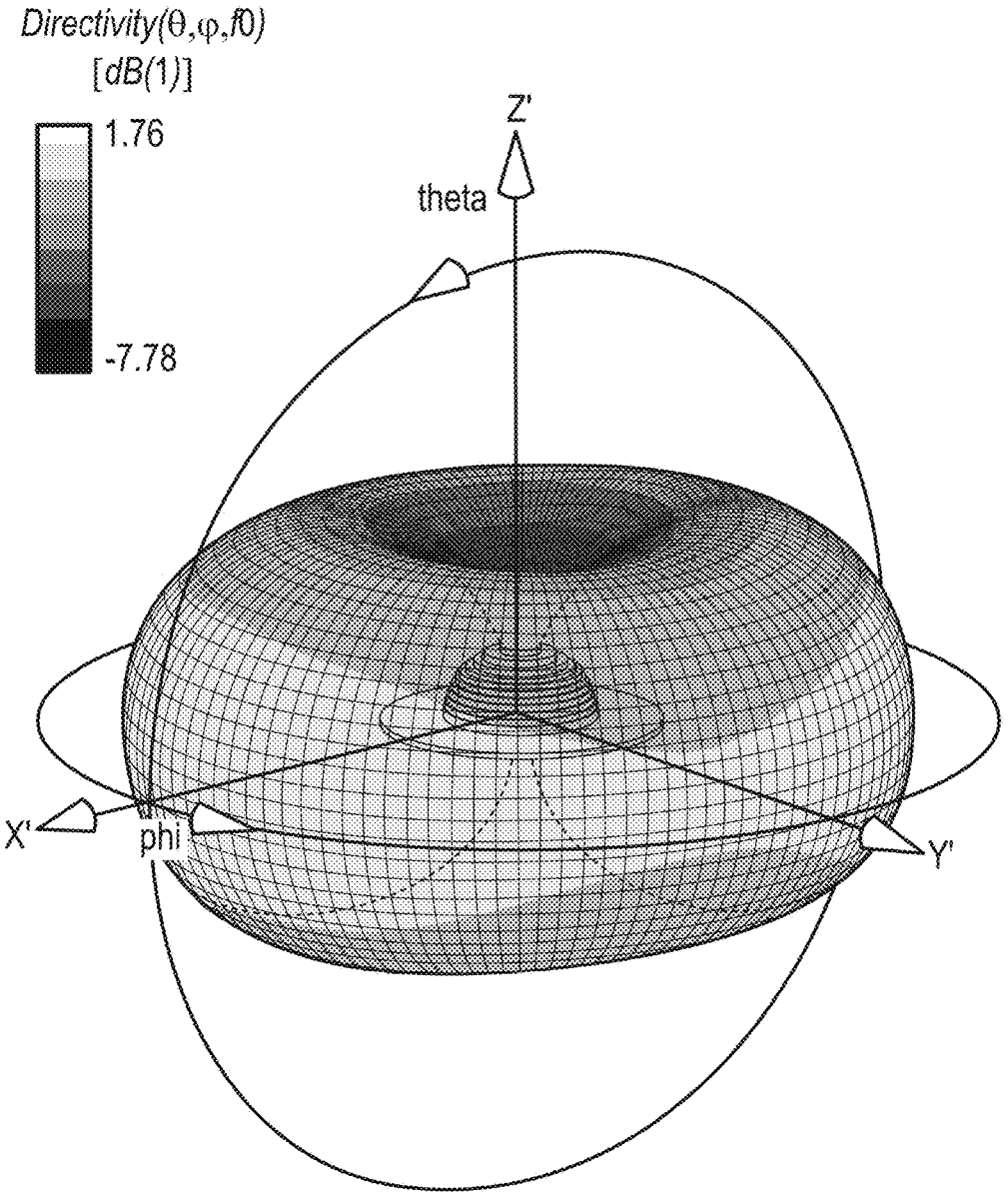
FIG. 12 is a three-dimensional plot of radiated power density over solid angle, for an example stacked hemispherical helix antenna fabricating according to disclosed technology.

FIG. 11 shows the radiation pattern of the wire antenna; it has a peak directivity of 1.5 dBi (referenced to isotropic radiation) and a pattern similar to that of a dipole antenna. FIG. 12 shows the radiation pattern of the first example FR4 PCB antenna, having a peak directivity of 1.75 dBi and a pattern similar to that of a dipole antenna. The gray-scale shading on both these Figures is linear in dB.

X. Definitions

Board

As used in this disclosure, a board is a solid sheet-like object having two surfaces, dubbed top and bottom, and a thickness between the top and bottom that is smaller than the transverse extent of the board's perimeter. Although many boards are rigid and have substantially parallel plane surfaces, this is not a requirement of the innovative technologies. Flex circuits using, for example, Kapton™ substrates can be employed with the innovative disclosures.

Wiring Board

A wiring board is a board having one or more conductive appurtenances attached thereto. The conductive appurtenance can be in the form of a discrete wire, with or without insulating encapsulation, a hollow conductor, or a substantially planar conductive trace; it can have any shape, and can be integrally formed with the board substrate by an additive or subtractive manufacturing process, or can be a separate piece affixed to the board substrate. Many wiring boards are manufactured by well-established printed circuit board technology known in the electronic arts, but neither PCBs nor PCB technology are a requirement of this invention.

Efficiency

When power is delivered to an antenna, some of the input power is radiated out, some is absorbed (for example by lossy dielectrics or ohmic loss in conductors), and some is reflected (sometimes understood as an impedance mismatch). As used in this disclosure, efficiency is the ratio of radiated power to input power, expressed as a percentage.

Radiator

As used in this disclosure, the terms "arm" and "radiator" are used interchangeably for any current-carrying portion of an antenna that influences radiated electromagnetic fields. In some examples radiators are generally linear in form, while in other examples an antenna radiator can have a straight or curved two-dimensional sheet shape, or a three-dimensional shape of a closed or open surface. Antenna radiators can include reactive components.

XI. Example Features

A desirable feature of compact antennas is the small size relative to the wavelength of operation. Many antennas are used in conjunction with electronic circuitry but constrain the available PCB real estate on which they are mounted. For example, some comparative antenna structures are mounted directly abutting a portion of a circuit board, so that the PCB space is directly occupied by the antenna. In other comparative antenna structures, the antenna requires a ground keepout under the antenna for proper operation. In both these cases, the entire antenna footprint (and in some cases an even greater area) is completely unavailable for other circuitry.

In contrast, antennas according to certain examples of the disclosed technologies are compatible with solid ground planes, thus maximizing the available PCB real estate on which components can be mounted. Further, by choosing a hemispherical antenna design and manufacturing the lower one or more layers of the antenna PCB stack with internal cutouts (for example, annular or C-shaped), PCB real estate interior to the antenna volume can also be used for other electronic circuitry, thus maximizing PCB utilization for a direct PCB mounted antenna.

Another feature of certain example PCB stack antennas is that individual layers can be independently modified. Particularly, the upper layers of a PCB stack antenna can be modified, to considerably vary the antenna characteristics, without modifying the lowest layer and the antenna feed. Thereby a modified antenna remains compatible with the old mounting pattern, and a redesigned antenna can be used without requiring any change to a host PCB.

Certain examples of the disclosed technology exhibit mechanical robustness, and easy, reliable manufacture through proven PCB techniques. Further, the PCB stack is inherently compatible with additional electronic components, and components (e.g., passive and/or reactive components such as inductors, capacitors, resistors, or active components) can be mounted on one or more of the PCB stack layers, interior or exterior to the antenna volume or in any position on a PCB stack layer. In some examples, reactive components can be used for the purpose of antenna loading. In the alternative or in addition to, receiving, monitoring, or transmitting circuitry can be directly integrated into the antenna assembly. The PCB stack antenna can be integrated onto a host PCB.

Through dielectric loading, the PCB stack antenna can be fabricated with a reduced size compared to some other antenna designs. Through choice of substrate material and board shapes and cutouts, the dielectric volume and loading can be easily controlled.

Generally, the PCB stack antenna offers a lower cost and robust solution compared to other alternatives having comparable features and performance.

XII. Example Material Properties

Table III shows some representative properties of two example wiring board dielectric materials at a frequency of 1 GHz.

TABLE III

| Property | FR-4 | Rogers RO3003 |
|---|---|---|
| Relative Permittivity | 4 | 3 |
| Loss Tangent | 0.01707 | 0.00132 |
| Conductivity [S/m] | 0.0038 | 0.0002 |

XIII. A Generalized Computer Environment

Figure 13:
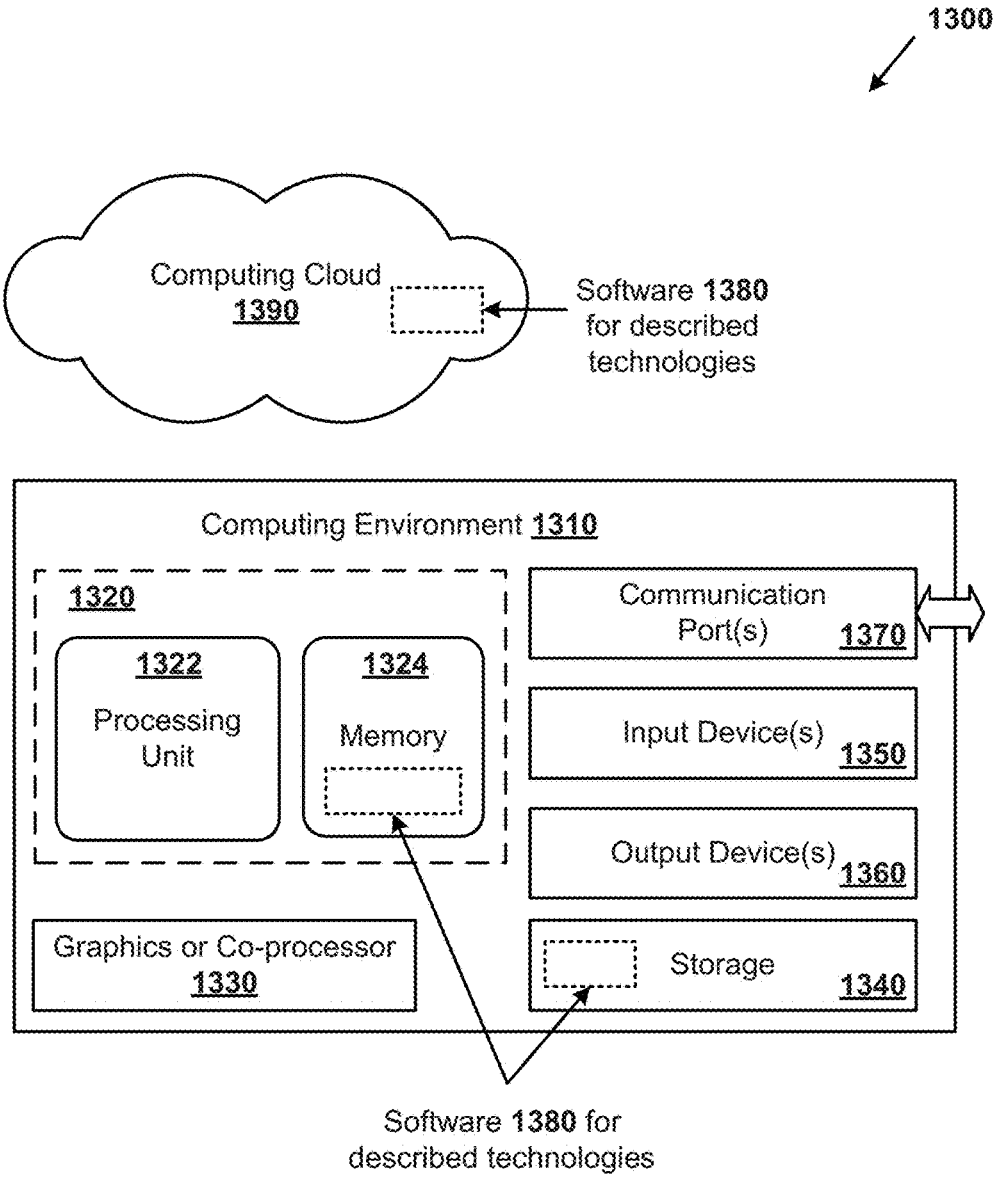
FIG. 13 is a diagram schematically depicting a computing environment suitable for implementation of certain examples of the disclosed technology.

FIG. 13 illustrates a generalized example of a suitable computing system 1300 in which described examples, techniques, and technologies, including design of an innovative antenna, can be implemented. The computing system 1300 is not intended to suggest any limitation as to scope of use or functionality of the present disclosure, as the innovations can be implemented in diverse general-purpose or special-purpose computing systems. For example, the computing system 1100 can be used to implement methods for mapping an idealized design to a planar wiring board approximation. The computing system 1100 can output data files (e.g., Gerber and NC drill files) that can be used to manufacture boards, including PCBs, that can be assembled into 3-D antennas as disclosed herein.

With reference to FIG. 13, computing environment 1310 includes one or more processing units 1322 and memory 1324. In FIG. 13, this basic configuration 1320 is included within a dashed line. Processing unit 1322 executes computer-executable instructions, such as for an antenna design method as described above. Processing unit 1322 can be a general-purpose central processing unit (CPU), processor in an application-specific integrated circuit (ASIC), or any other type of processor. In a multi-processing system, multiple processing units execute computer-executable instructions to increase processing power. Computing environment 1310 can also include a graphics processing unit or co-processing unit 1330. Tangible memory 1324 can be volatile memory (e.g., registers, cache, or RAM), non-volatile memory (e.g., ROM, EEPROM, or flash memory), or some combination thereof, accessible by processing units 1322, 1330. The memory 1324 stores software 1380 implementing one or more innovations described herein, in the form of computer-executable instructions suitable for execution by the processing unit(s) 1322, 1330. The memory 1324 can also store database data, including some or all of solid model data and material properties. The memory 1324 can also store some or all of simulation data, and other configuration and operational data.

A computing system 1310 can have additional features, such as one or more of storage 1340, input devices 1350, output devices 1360, or communication ports 1370. An interconnection mechanism (not shown) such as a bus, controller, or network interconnects the components of the computing environment 1310. Typically, operating system software (not shown) provides an operating environment for other software executing in the computing environment 1310, and coordinates activities of the components of the computing environment 1310.

The tangible storage 1340 can be removable or non-removable, and includes magnetic disks, magnetic tapes or cassettes, CD-ROMs, DVDs, or any other medium which can be used to store information in a non-transitory way and which can be accessed within the computing environment 1310. The storage 1340 stores instructions of the software 1380 (including instructions and/or data) implementing one or more innovations described herein.

The input device(s) 1350 can be a mechanical, touch-sensing, or proximity-sensing input device such as a keyboard, mouse, pen, touchscreen, or trackball, a voice input device, a scanning device, or another device that provides input to the computing environment 1310. The output device(s) 1360 can be a display, printer, speaker, optical disk writer, or another device that provides output from the computing environment 1310.

The communication port(s) 1370 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, acoustic, or other carrier.

In some examples, computer system 1300 can also include a computing cloud 1390 in which instructions implementing all or a portion of the disclosed technology are executed. Any combination of memory 1324, storage 1340, and computing cloud 1390 can be used to store software instructions and data of the disclosed technologies.

The present innovations can be described in the general context of computer-executable instructions, such as those included in program modules, being executed in a computing system on a target real or virtual processor. Generally, program modules or components include routines, programs, libraries, objects, classes, components, data structures, etc. that perform particular tasks or implement particular abstract data types. The functionality of the program modules can be combined or split between program modules as desired in various embodiments. Computer-executable instructions for program modules can be executed within a local or distributed computing system.

The terms "system," "environment," and "device" are used interchangeably herein. Unless the context clearly indicates otherwise, neither term implies any limitation on a type of computing system, computing environment, or computing device. In general, a computing system, computing environment, or computing device can be local or distributed, and can include any combination of special-purpose hardware and/or general-purpose hardware and/or virtualized hardware, together with software implementing the functionality described herein.

XIV. General Considerations

As used in this application, the singular forms "a," "an," and "the" include the plural forms unless the context clearly dictates otherwise. Additionally, the terms "includes" and "incorporates" mean "comprises." Further, the term "coupled" encompasses mechanical, electrical, magnetic, optical, as well as other practical ways of coupling or linking items together, and does not exclude the presence of intermediate elements between the coupled items. Furthermore, as used herein, the term "and/or" means any one item or combination of items in the phrase.

The systems, methods, and apparatus described herein should not be construed as being limiting in any way. Instead, this disclosure is directed toward all novel and non-obvious features and aspects of the various disclosed embodiments, alone and in various combinations and subcombinations with one another. The disclosed systems, methods, and apparatus are not limited to any specific aspect or feature or combinations thereof, nor do the disclosed things and methods require that any one or more specific advantages be present or problems be solved. Furthermore, any features or aspects of the disclosed embodiments can be used in various combinations and subcombinations with one another.

Although the operations of some of the disclosed methods are described in a particular, sequential order for convenient presentation, it should be understood that this manner of description encompasses rearrangement, unless a particular ordering is required by specific language set forth below. For example, operations described sequentially can in some cases be rearranged or performed concurrently. Moreover, for the sake of simplicity, the attached figures may not show the various ways in which the disclosed things and methods can be used in conjunction with other things and methods. Additionally, the description sometimes uses terms like "analyze," "apply," "determine," "display," "estimate," "generate," "produce," and "use" to computer operations in a computer system. These terms are high-level abstractions of the actual operations that are performed by a computer. The actual operations that correspond to these terms will vary depending on the particular implementation and are readily discernible by one of ordinary skill in the art.

Theories of operation, scientific principles, or other theoretical descriptions presented herein in reference to the apparatus or methods of this disclosure have been provided for the purposes of better understanding and are not intended to be limiting in scope. The apparatus and methods in the appended claims are not limited to those apparatus and methods that function in the manner described by such theories of operation.

Any of the disclosed methods can be implemented as computer-executable instructions or a computer program product stored on one or more computer-readable storage media, such as tangible, non-transitory computer-readable storage media, and executed on a computing device (e.g., any available computing device, including tablets, smart phones, or other mobile devices that include computing hardware). Tangible computer-readable storage media are any available tangible media that can be accessed within a computing environment (e.g., one or more optical media discs such as DVD or CD, volatile memory components (such as DRAM or SRAM), or nonvolatile memory components (such as flash memory or hard drives)). By way of example, and with reference to FIG. 13, computer-readable storage media include memory 1324, and storage 1340. The term computer-readable storage media does not include signals and carrier waves. In addition, the term computer-readable storage media does not include communication ports (e.g., 1370).

Any of the computer-executable instructions for implementing the disclosed techniques as well as any data created and used during implementation of the disclosed embodiments can be stored on one or more computer-readable storage media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network, a cloud computing network, or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in ABAP, Adobe Flash, C, C++, C#, Curl, Dart, Fortran, Java, JavaScript, Julia, Lisp, Matlab, Octave, Perl, Python, R, Ruby, SAS, SPSS, SQL, WebAssembly, any derivatives thereof, or any other suitable programming language, or, in some examples, markup languages such as HTML or XML, or in any combination of suitable languages, libraries, and packages. Likewise, the disclosed technology is not limited to any particular computer or type of hardware. Certain details of suitable computers and hardware are well known and need not be set forth in detail in this disclosure.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, infrared, and optical communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved. The technologies from any example can be combined with the technologies described in any one or more of the other examples.

In view of the many possible embodiments to which the principles of the disclosed subject matter may be applied, it should be recognized that the illustrated embodiments are only preferred examples and should not be taken as limiting the scope of the claims to those preferred examples. Rather, the scope of the claimed subject matter is defined by the following claims. We therefore claim as our invention all that comes within the scope of these claims and their equivalents.

We claim:

1. A three-dimensional antenna, comprising:

a stack of planar wiring boards, at least one of the planar wiring boards comprising one or more disjoint metallizations in electrical contact with at least one disjoint metallization on an adjacent one of the planar wiring boards; and on a given one of the planar wiring boards, an antenna feed comprising a microstrip line and at least one impedance matching component.

2. The three-dimensional antenna of claim 1, wherein the three-dimensional antenna comprises one or more radiators in the shape of a hemispherical helix.

3. The three-dimensional antenna of claim 1, further comprising a ground plane.

4. The three-dimensional antenna of claim 1, further comprising a discrete electrical component mounted on a first one of the planar wiring boards and electrically coupled to a first disjoint metallization of the first planar wiring board.

5. The three-dimensional antenna of claim 1, further comprising, on at least one of the planar wiring boards, a wrap-around terminal electrically connecting a disjoint metallization on a first surface of the planar wiring board with a second surface of the planar wiring board opposite the first surface.

6. The three-dimensional antenna of claim 1, wherein at least one of the planar wiring boards has a cutout.

7. The three-dimensional antenna of claim 6, wherein at least two of the planar wiring boards have at least partially overlapping cutouts forming a cavity.

8. The three-dimensional antenna of claim 7, wherein a surface of the cavity is at least partially metallized to form a Faraday shield.

9. The three-dimensional antenna of claim 7, further comprising one or more discrete passive or active electronic components mounted inside the cavity.

10. The three-dimensional antenna of claim 1, wherein a first radiator of the three-dimensional antenna comprises two of the disjoint metallizations on an adjacent pair of the planar wiring boards, and the electrical contact between the two disjoint metallizations is a capacitive contact.

11. The three-dimensional antenna of claim 1, wherein at least one planar wiring board is a printed wiring board having three or more conducting layers.

12. The three-dimensional antenna of claim 1, wherein at least one planar wiring board is a semiconductor die.

13. A three-dimensional antenna system comprising two or more three-dimensional antennas according to claim 1, mounted on a common support.

14. The three-dimensional antenna of claim 1, wherein the at least one planar wiring board comprises a first planar wiring board, and further comprising a spacer separating the first planar wiring board from the adjacent wiring board.

15. A three-dimensional antenna, comprising:

a stack of planar wiring boards, at least one of the planar wiring boards comprising one or more disjoint metallizations in electrical contact with at least one disjoint metallization on an adjacent one of the planar wiring boards; and at least one lumped component positioned on a surface of a first one of the planar wiring boards and electrically coupled to a first disjoint metallization of the first planar wiring board.

16. A method comprising:

providing a plurality of substrates, each of the substrates comprising one or more disjoint metallizations;

forming a three-dimensional antenna by stacking the plurality of substrates, wherein each of the disjoint metallizations is in electrically conductive contact with at least one disjoint metallization on an adjacent one of the substrates; and tuning the three-dimensional antenna for one or more of: a target resonant frequency, an impedance match to a target transmission line, a VSWR on a feed transmission line, or a reflection coefficient.

17. The method of claim 16, wherein the forming comprises mechanical attachment of one or more adjacent substrates by soldering.

18. The method of claim 16, further comprising:

forming one or more ground contacts between respective disjoint metallizations and a common ground plane.

19. The method of claim 16, further comprising:

designing the substrates and the disjoint metallizations so that the formed three-dimensional antenna approximates an idealized antenna design.

20. The method of claim 16, wherein the tuning comprises tuning for an impedance match to a target transmission line.

* * * * *